US008327768B2

(12) United States Patent
Scarr

(10) Patent No.: US 8,327,768 B2
(45) **Date of Patent: *Dec. 11, 2012**

(54) RING AIRFOIL GLIDER EXPENDABLE CARTRIDGE AND GLIDER LAUNCHING METHOD

(76) Inventor: Kimball Rustin Scarr, Connersville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/189,147

(22) Filed: Jul. 22, 2011

(65) Prior Publication Data

US 2012/0073465 A1 Mar. 29, 2012

Related U.S. Application Data

(63) Continuation of application No. 12/045,647, filed on Mar. 10, 2008, now Pat. No. 7,987,790, which is a continuation of application No. 10/803,260, filed on Mar. 18, 2004, now abandoned.

(60) Provisional application No. 60/455,692, filed on Mar. 18, 2003.

(51) Int. Cl.
*F42B 10/36* (2006.01)

(52) U.S. Cl. ..... 102/503; 102/502

(58) Field of Classification Search ..... 102/503, 102/502, 520, 521, 370, 512; 446/176; 124/56, 124/57, 60, 61; 42/105
See application file for complete search history.

(56) References Cited

U.S. PATENT DOCUMENTS

| | | | | |
|---|---|---|---|---|
| 2,115,028 A | | 4/1938 | Orwell | |
| 2,784,711 A | | 3/1957 | Vaughn | |
| 2,918,006 A | | 12/1959 | VonZborowski | |
| 3,264,776 A | | 8/1966 | Morrow | |
| 3,526,377 A | | 5/1967 | Flatau | |
| 3,340,769 A | | 9/1967 | Waser | |
| 3,400,661 A | | 9/1968 | Coon | |
| 3,415,193 A | * | 12/1968 | Campagnuolo et al. | 102/519 |
| 3,474,499 A | | 10/1969 | Flatau | |
| 3,476,048 A | | 11/1969 | Barr et al. | |
| 3,493,199 A | | 9/1970 | Flatau | |

(Continued)

FOREIGN PATENT DOCUMENTS

EP 0 857 940 B1 8/2002

(Continued)

OTHER PUBLICATIONS

U.S. Appl. No. 12/181,190, Response filed Apr. 4, 2001, 36 pgs.

(Continued)

*Primary Examiner* — Benjamin P Lee
(74) *Attorney, Agent, or Firm* — John V. Daniluck; Bingham Greenebaum Doll LLP

(57) ABSTRACT

My Ring Airfoil Glider Expendable Cartridge and Glider Launching Method is form launching a reduced caliber ring airfoil glider from a conventional grenade launcher barrel with preferred application for less lethal use. A caseless ammunition base contains a primer communicating with a propellant in a rupture disk sealed chamber with a vent used to create, seal and channel propelling gas into a space behind a sabot mounted on a central guide on the base, whereupon releasing the gas, the sabot aligns, seals, pushes and rotates the glider in passage down the barrel, to a point of maximum velocity, whereon, the propelling gas is vented ahead of the glider by the central passage in the sabot as it leaves the guide, whereupon, the bore decelerates the sabot by friction freeing the glider to fly down the bore centered by a turbulent boundary layer of air until it exits the muzzle.

18 Claims, 16 Drawing Sheets

U.S. PATENT DOCUMENTS 3,584,581 A 6/1971 Flatau et al.
3,585,934 A 6/1971 Mueller
3,645,694 A 2/1972 Flatau
3,738,279 A 6/1973 Eyre et al.
3,837,107 A 9/1974 Swaim et al.
3,877,383 A 4/1975 Flatau
3,898,932 A * 8/1975 Flatau et al. ..... 102/502
3,912,197 A * 10/1975 McKown et al. ..... 244/3.13
3,919,799 A 11/1975 Austin, Jr. et al.
3,951,070 A * 4/1976 Flatau et al. ..... 102/502
3,954,057 A 5/1976 Flatau
3,956,844 A 5/1976 Misevich et al.
3,980,023 A 9/1976 Misevich
3,981,093 A 9/1976 Reed
3,982,489 A * 9/1976 Flatau et al. ..... 102/502
4,052,927 A 10/1977 Flatau
4,132,148 A 1/1979 Meistring et al.
4,151,674 A 5/1979 Klahn et al.
4,154,012 A * 5/1979 Miller ..... 42/105
4,164,904 A 8/1979 Laviolette
4,190,476 A * 2/1980 Flatau et al. ..... 156/218
4,212,244 A 7/1980 Flatau
4,246,721 A 1/1981 Bowers
4,262,597 A 4/1981 Olson
4,270,293 A 6/1981 Plumer et al.
4,301,736 A 11/1981 Flatau et al.
4,337,911 A 7/1982 Flatau
4,390,148 A 6/1983 Cudmore
4,413,565 A * 11/1983 Matthey et al. ..... 102/503
4,539,911 A 9/1985 Flatau
4,579,059 A 4/1986 Flatau
4,612,860 A 9/1986 Flatau
4,656,946 A 4/1987 Gordon et al.
4,656,947 A 4/1987 Gordon et al.
4,735,148 A 4/1988 Holtzman
4,742,774 A 5/1988 Flatau
4,753,152 A 6/1988 Baechler
4,776,281 A 10/1988 Chiang et al.
4,790,788 A 12/1988 Hill
4,827,847 A 5/1989 Laviolette et al.
4,850,923 A 7/1989 Etheridge
4,882,997 A 11/1989 Baxter et al.
4,936,218 A 6/1990 Wosenitz
4,938,146 A 7/1990 Gunther
4,969,397 A 11/1990 Gunther
H942 H 8/1991 Pardee
5,067,406 A 11/1991 Olson et al.
5,275,110 A 1/1994 Flatau
5,303,632 A 4/1994 Kivity
5,317,866 A 6/1994 Murray et al.
5,377,656 A 1/1995 Lewinski et al.
5,397,261 A 3/1995 Malewicki et al.
5,515,787 A 5/1996 Middleton
5,526,749 A 6/1996 Teetzel
5,531,210 A 7/1996 Meiser et al.
5,535,729 A 7/1996 Griffin et al.
5,546,845 A 8/1996 Wossner
5,655,947 A 8/1997 Chen
5,677,505 A 10/1997 Dittrich
5,747,719 A 5/1998 Bottesch
5,816,880 A 10/1998 Forti et al.
5,868,597 A 2/1999 Chen
5,936,189 A 8/1999 Lubbers
5,970,970 A 10/1999 Vanek et al.
6,041,712 A 3/2000 Lyon
6,076,511 A 6/2000 Grimm et al.
6,079,398 A 6/2000 Grimm
6,083,127 A * 7/2000 O'Shea ..... 473/571
6,145,441 A * 11/2000 Woodall et al. ..... 102/502
6,152,123 A 11/2000 Ferrante et al.
6,178,889 B1 1/2001 Dindl
6,220,918 B1 4/2001 Laronge
6,257,146 B1 * 7/2001 Stonebraker ..... 102/346
6,298,788 B1 10/2001 Woods
6,324,983 B1 12/2001 Dindl
6,324,984 B1 12/2001 Dindl
6,374,741 B1 4/2002 Stanley
6,454,623 B1 9/2002 Flatau
6,564,719 B2 5/2003 Saxby
6,575,098 B2 6/2003 Hsiung
6,599,161 B2 7/2003 Hunter
6,647,890 B2 * 11/2003 Findlay ..... 102/503
6,671,989 B2 * 1/2004 Vanek et al. ..... 42/18
6,722,252 B1 4/2004 O'Dwyer
6,722,283 B1 4/2004 Dindl
6,742,509 B2 6/2004 Hunter et al.
6,782,828 B2 8/2004 Widener
6,782,829 B1 8/2004 Han
6,832,557 B2 12/2004 Torsten
6,860,187 B2 3/2005 O'Dwyer
6,915,793 B2 7/2005 Vanek et al.
6,953,033 B2 10/2005 Vanek et al.
6,983,700 B1 1/2006 Malejko
6,990,905 B1 1/2006 Manole
7,004,074 B2 2/2006 Van Stratum
7,007,424 B2 3/2006 Vanek et al.
7,021,219 B1 4/2006 Dindl
D522,070 S 5/2006 Hunter et al.
7,063,082 B2 6/2006 Vanek et al.
7,089,863 B1 8/2006 Dindl
7,165,496 B2 1/2007 Reynolds
7,191,708 B2 3/2007 Ouliarin
7,207,273 B2 4/2007 Brunn
7,207,276 B1 4/2007 Dindl
7,287,475 B2 10/2007 Brunn
7,377,204 B2 5/2008 Simmons
7,418,896 B1 9/2008 Dindl
7,430,825 B2 * 10/2008 Vanek et al. ..... 42/18
7,444,941 B1 11/2008 Brunn
7,451,702 B1 11/2008 Dindl
7,475,638 B2 1/2009 Haeselich
7,500,434 B2 * 3/2009 Flatau et al. ..... 102/503
7,503,521 B2 3/2009 Maynard
7,549,376 B1 6/2009 Grossman
7,568,433 B1 8/2009 Farina
7,581,500 B2 * 9/2009 Flatau ..... 102/503
7,621,208 B2 11/2009 Huffman
7,654,458 B1 2/2010 Kokodis
7,658,151 B2 2/2010 Genis
7,681,503 B1 3/2010 Fridley
7,690,310 B2 4/2010 Engel
7,793,591 B1 9/2010 Van Stratum
7,802,520 B2 9/2010 Van Stratum
7,819,065 B2 10/2010 Haeselich
7,823,509 B2 11/2010 Dindl
2002/0088367 A1 7/2002 MacAleese
2003/0000122 A1 * 1/2003 Vanek et al. ..... 42/16
2003/0089221 A1 5/2003 O'Dwyer
2003/0097952 A1 * 5/2003 Findlay ..... 102/503
2004/0000250 A1 * 1/2004 Stratum ..... 102/441
2005/0066843 A1 * 3/2005 Flatau et al. ..... 102/503
2005/0183615 A1 * 8/2005 Flatau ..... 102/503
2006/0096492 A1 * 5/2006 Flatau et al. ..... 102/502
2007/0079819 A1 4/2007 Vanek et al.
2008/0006171 A1 1/2008 Confer
2008/0223246 A1 9/2008 Dindl
2010/0089226 A1 4/2010 Jones
2010/0095863 A1 4/2010 Kolnik
2010/0101443 A1 4/2010 Rosales
2010/0132580 A1 6/2010 Nazdratenko
2010/0212533 A1 8/2010 Brunn
2010/0263568 A1 10/2010 Huffman
2010/0282118 A1 11/2010 Ladyjensky

FOREIGN PATENT DOCUMENTS

EP 1 228 342 B1 7/2003
EP 1 376 046 A1 1/2004
EP 1 104 541 B1 3/2004
EP 0 966 650 B1 9/2005
EP 1 079 199 B1 10/2005
WO 8101046 4/1981
WO 8707708 12/1987
WO 9853269 11/1998
WO 9937968 7/1999
WO 2006083280 8/2006
WO 2006092637 9/2006
WO WO 2008/020857 A2 2/2008

| | | |
|---|---|---|
| WO | WO 2008/045131 | 4/2008 |
| WO | 2008099353 | 8/2008 |
| WO | 2009048664 | 4/2009 |
| WO | 2009137370 | 11/2009 |

OTHER PUBLICATIONS

U.S. Appl. No. 12/342,915, Response filed May 3, 2011, 16 pgs.
U.S. Appl. No. 10/803,260, Office Action dated Oct. 16, 2007.
U.S. Appl. No. 12/045,647, Office Action dated Jun. 11, 2010.
U.S. Appl. No. 12/045,647, Response dated Dec. 13, 2010.
U.S. Appl. No. 12/045,647, Notice of Allowance dated Mar. 21, 2011.
U.S. Appl. No. 12/342,915, Notice of Allowance dated Jul. 26, 2011.
U.S. Appl. No. 12/181,190, Office Action mailed Oct. 4, 2010, 8 pgs.
U.S. Appl. No. 12/342,913, Office Action mailed Dec. 3, 2010, 5 pgs.

* cited by examiner

RING AIRFOIL GLIDER EXPENDABLE CARTRIDGE AND GLIDER LAUNCHING METHOD

CROSS REFERENCE TO RELATED APPLICATIONS

This application is a continuation of U.S. patent application Ser. No. 12/045,647, filed Mar. 10, 2008, now U.S. Pat. No. 7,987,790, which is a continuation of U.S. patent application Ser. No. 10/803,260, filed Mar. 18, 2004, which claims the benefit of priority of U.S. Provisional Patent Application No. 60/455,692, filed Mar. 18, 2003, all of which are incorporated herein by reference.

BACKGROUND OF THE INVENTION

The ring airfoil is really the only 'new' and technologically advanced projectile technology in the last 400 years. In fact, the traditional mathematical descriptions of a projectile and its 'flight' do not apply. This is because a ring airfoil projectile is not a real projectile in any sense, other than possibly that it can be launched from a gun, it is a lifting body or more precisely a glider. In all, the performance and possibilities offered by a ring airfoil glider are very enticing.

Ring airfoil technology is particularly advantageous for less lethal applications. Usually, these non-penetrating projectiles must have a large frontal area and very low mass to limit undesired human vulnerability effects. In conventional projectiles this equates with very poor ballistic performance and the need for higher than acceptable close range danger of injury and lower than desired effectiveness at the long ranges presented by riot control and military operations. Conversely, the ring airfoil naturally fits the less lethal tactical situation perfectly: light with large effective frontal area with phenomenal 'down range' properties.

Ring airfoil gliders (RAGS) are tubular-shaped wings which fly or glide through the air much like a conventional winged glider. Unlike a conventional ballistic projectile, the ring airfoil glider produces lift which gives it a much flatter trajectory. Depending on the design and launching parameters of the glider, the lift results in the glider rising to only small fraction of the height of the trajectory of a conventional ballistic projectile at the same range. The lifting capability reduces or eliminates the problem of range estimation errors and allows ring airfoil gliders to achieve higher hit probabilities at long range than all other candidate low lethality or grenade projectiles.

curved flight. Conversely, the ring airfoil glider has strong gyroscopic forces induced by spinning the projectile/glider's mass, concentrated near its outer circumference. The gyroscopic stability maintains its original launch orientation (along its line of departure). As a ring airfoil glider proceeds along its trajectory and begins to fall under the pull of gravity, the flight path starts to curve downward toward the ground.—Therefore, the glider becomes canted in relation with the airflow over its wing surface causing lift forces to be created on it in the direction opposite to the gravitational pull. This functions exactly like increasing the pitch of a helicopter's rotor, which is also airfoil shaped, to increase the rotor's lift. Although, the ring airfoil has a slight curve in its flight path until it stalls, at which point it drops rapidly, it appears to the casual observer to travel a straight line and then suddenly fall to the ground. Ufano, a contemporary of Galileo nearly five hundred years ago, wrongly thought conventional projectiles traveled like this. The flat trajectory of the ring airfoil is a primary advantage over conventional projectiles.

It should be noted that this 'pitch' change increases aerodynamic drag on the ring airfoil glider. As the airfoil is traveling at an angle to the airflow, not only is its presented area increased, but the airflow over it is bent more to cause increase in its lifting force and increasing its induced drag; induced drag is caused by the energy which is expended due to the bending of airflow around the airfoil resulting in lift and the associated airflow separation at the trailing edge of the airfoil as its angle of attack is increased or pitch increases. Simply stated, the ring airfoil glider converts some of its momentum to lifting forces at the expense of its forward velocity. However, in comparison to a conventional projectile a ring airfoil's drag is a very tiny fraction.

For comparison purposes, consider:

The less lethal M-1006 Sponge Grenade 40 mm round recently developed by David Lyon at ARL (Army Research Laboratory) now Edgewood RD&E Center in Aberdeen, Md. with help from Frank Dindl at TACOM-ARDEC at Picatinny Arsenal, N.J. out of programs of 30 years ago. It is a conventional ammunition projectile with low drag, short flight times and just acceptable human vulnerability effects. It would be very difficult to improve on its performance using conventional projectile technology.

The RAG M743 projectile (glider) developed by Abe Flatau and his group at ERDEC (the Edgewood RD&E Center) some 30 years ago serves to illustrate the contrast between conventional and lifting projectiles.

A general comparison is as follows:

Conventional Projectile vs. Ring Airfoil Glider Flight Characteristics
All projectiles 35 grams

| | Sponge Grenade (Std. Launch Velocity) | | RAG M743 (Std. Launch Velocity) | | Plus RAG M743 (Equivalent Muzzle Velocity to Sponge Grenade) | |
|---|---|---|---|---|---|---|
| Distance | Muzzle | 75 meters | Muzzle | 75 meters | Muzzle | 75 meters |
| Velocity | 82 m/sec | 52 m/sec | 60 m/sec | 50 m/sec | 82 m/sec | 67 m/sec |
| Time of Flight | — | 1.12 sec | — | 1.36 sec | — | 1.00 sec |
| Mid-Range Trajectory | 11 | 1.625 meters | — | 0.75 | — | 0.55 meters |

Conventional ballistic projectiles have their longitudinal axis oriented along their flight path. As the projectile travels through its curved ballistic flight path the projectile changes its attitude or orientation from its original line of departure to align with its flight path. Projectiles have a parabolic shaped In spite of its converting momentum to lift, the M743 loses only 10 meters/sec, compared to the Sponge Grenade's 30 meters/sec. loss over the same distance. The change in speed results in a corresponding square law change in kinetic energy, i.e. change in the human vulnerability results. In addition, the lower speed RAG experiences only half the trajectory height, while the higher speed RAG is less than a third of the trajectory, even though the Sponge Grenade has a 0.24 second lower time of flight; i.e., less time to be deflected by gravity.

Generally, the higher the peak trajectory (above the line of sight), the more difficult it is for the shooter to hit a target: due to his need to estimate how much to compensate for the projectile's drop—a task made more difficult when like a soldier is under fire. A useful concept in measuring the necessity of accurate range estimation is the 'danger space.' The danger space is the distance over which the projectile remains within a man's height. If the projectile's velocity is low with a corresponding long flight time, the trajectory curves steeply, and there will be a portion of the range for which the projectile will pass harmlessly over a man's head. In this case, the danger space consists of nearby ranges where the projectile is still within a man's height and the last part of the trajectory, as the projectile falls within the man's height before ending in the projectile's contact with the ground. The latter portion is shorter, as the trajectory is steeper at the end. And, for less lethal devices like the sponge grenade the nearby ranges are not usable due to the increased risk of unacceptable injuries.

With a flat trajectory like that of the ring airfoil glider, this ineffective zone within the defined effective range disappears, leaving one continuous danger space from muzzle to the target. This allows the shooter to quickly acquire the target without the need for sophisticated (and fragile) range finders and computers that are useless when the battery runs down—or the hardware or software malfunctions.

Cross wind performance for less lethal kinetic ammunition projectiles has always been problematic. This is due to less lethal lightweight large diameter projectiles having low sectional density and low launch speeds, i.e. easily pushed around by the wind, combined with high velocity degrades resulting in long flight times, i.e. time to be deflected by the wind. Generally, the ring airfoil helps to alleviate these problems by decreasing the flight time. However, the lifting effect of the ring airfoil does partially come into play with cross winds, much like what happens with its drop characteristics. For wind blowing against the glider at low angles of attack, less than 10" to 15O, the lifting force causes the glider to be deflected less than usual for a conventional projectile. As the wind angle increases the lift effect tapers off until it is not present, at which point the projectile behaves like a conventional projectile, although it has a lower flight time. As the wing angle passes beyond ninety degrees and becomes a tail wind at shallow angle, less than 10' to 15", the glider slightly increases its deflection but this is offset by the reduced airspeed, when traveling with the wind, and the lower flight time. Practically to the shooter, this behavior is not usually perceived as either worse or better than a conventional projectile's performance due to the fact that he has no direct comparison to the round he is presently firing. Wind deflection, other than in artillery, is a guessing game for the soldier in the field; he has no means of measuring wind velocity knowing its precise direction and the time to calculate wind deflection when he fires the weapon-he can only compensate for the next shot, after observing the impact point of the round.

The one requirement for the near-ideal trajectory characteristics of ring airfoil gliders is that the gyroscopic forces and the aerodynamic lifting forces should be longitudinally centered at the same point on the airfoil's section. The U.S. Army's M742 & M743 are examples of the ring airfoil glider with unbalanced lift and gyroscopic forces. [It should be noted all less than lethal use ring airfoil projectiles/gliders subsequent to the M7421743 are copies of those devices, except for the present inventor. This is due to the difficulty in developing a new ring airfoil design, the practical problem and expense of proving its human vulnerability safety, and that the technology's originator and leading proponent, Abe Flatau, having been heavily relied on as consultant to every subsequent developer.

The U.S. Army's M743 Sting RAG and M742 Soft RAG (gliders, see FIG. 1) were designed with an aft center of gravity (inherently unstable) to allow the installation of CS tear gas packets in pockets evenly spaced around the forward outside diameter of the glider. The CS packet's mass made for a more balanced downrange flight path in the original M742 Soft RAG; both are based on the same molded rubber ring airfoil design. The M743 Sting RAG suffered from the loss of this payload mass, as it made it tail heavy. The imbalance between the center of pressure and center of gravity combined to create a moment arm on the RAG glider. In flight, the lift forces acting through the moment arm cause the RAG glider to become canted in a lateral direction in relation to the airflow and gravity. This, in turn, causes the glider to behave like a curve-pitched baseball.

In addition, the cross section of the M7421743 RAG glider is not an ideal airfoil: It is molded of rubber with rough mold flashing left in place at critical places for airflow. Adding to the problem, it is wound with a relatively rough paper cover: needed to prevent centrifugal forces from deforming the flexible rubber glider and to hold the CS packets in place in the M742 Soft RAG. Additionally, the flat topped and rectilinear CS pockets on the airfoil's outside high point, an area that should have been curved, made the M7421743 less than an ideal airfoil section. All these factors contributed to relatively high drag coefficients and associated velocity degrade characteristics. The lift force disproportionably decreases and changes position along the length of the M7421743 airfoil section as the glider slows down, increasing the angle of attack and resulting in a progressively more unbalanced glider flight configuration. This change of balance between the forces causes an undesirable increase in this glider's trajectory curvature at ranges over 60 meters. It is due to the concerted effort of Abe Flatau and his staff at the Army's ERDEC lab that the M7421743 worked as well as it did, while meeting the conflicting requirements they were given. The balance struck on the M7421743 limited it to a narrow launch window of spin rate and velocity to achieve its goals over the desired distance. To complete the story, the preferred M742 Soft RAG projectile's packets of CS tear gas had a small unavoidable variance in weight. This, in turn, created a gyroscopic imbalance in the spinning projectile. This imbalance increased the dispersion and further degraded the accuracy of the M742 Soft RAG. Poor dispersion and limited shelf storage life of the CS fill combined with its high cost of production doomed the M742 Soft RAG. It was type-classified for production but not produced in quantities beyond that required for testing (a few hundred). The M743 Sting RAG was produced for inventory, about 500,000 units, but never issued. Ultimately, the reasons for the failure of the original non-lethal RAG have to do more with the politics of the time rather than technical inadequacies as the M742 and M743 and their associated M234 launcher attachment for the M-16A1. Simply, they really did meet and exceed all their original requirements its just their mission was a political illusion.

Back to Ring Airfoil Technology

In less than lethal projectile technology there is a trade-off between the poor aerodynamics of the large cross-sectional area projectile weapons required to prevent the blunt trauma weapon from being a penetrating one and the need for acceptable ranging and flight characteristics. The key to the ring airfoil glider projectile's superior aerodynamic and terminal performance is the trade off between its cross-sectional area and the density of the medium in which it travels.

Ring airfoil gliders have excellent aerodynamic drag properties due to their streamlined shape and low cross-sectional area. The fluidity and low density of air drastically reduces drag forces on a ring airfoil glider as the air simply passes through the center of the projectile, rather than traveling around the entire projectile's perimeter. On the other hand, a ring airfoil glider encountering flesh has a very low ballistic coefficient, as flesh is a high density, viscous, elastic solid. Flesh cannot flow through the hole in the center of the ring airfoil glider at the practical speeds that a less lethal ring airfoil travels. Therefore, the ring airfoil glider's energy is dissipated on the surface over an area encompassed by the outside diameter of the projectile, an area much larger than its aerodynamic cross-section. This phenomenon was demonstrated during the extensive biophysical work done on the Army's M742 and M743 RAG projectiles at ERDEC. These results were obtained in testing the device against various live animal targets at impacts from low velocity were no injury was produced to high velocity impact where death was a certainty.

Ring airfoil gliders have excellent aerodynamic drag properties due to their streamlined shape and low cross-sectional area. Be this as it may, the very simple basis for the ring airfoil's improved effectiveness is that it has a dual effective sectional density. The sectional density when considered over the outer diameter of the ring airfoil is very low and this is what is important in limiting dangerous injuries and how it performs in analysis of blunt trauma. [Conventional projectiles only function from this basis outer diameter sectional density for both their flight and impact properties a conventional less lethal projectile can be soft or 'expand' on contact but this limits both its blunt trauma rating and its pain production, i.e. low effective contact pressure. One wonders why a soft projectile would be considered, for any less lethal, as it only decreases the effectiveness of the projectile in producing pain and can lead to actually increasing the danger due to higher than needed levels of energy—reduces efficiency in engineering parlance. If one takes notice, all less lethal projectiles that are reasonably safe do not break the skin, hard or soft.]

The real advantage is the second sectional density of the ring airfoil: that based on its aerodynamic presented area. Although, the mass is the same the presented area is significantly less than its outer diameter area. This presented area sectional density reduces its flight drag, and it increases its contact pressure on a target where it actually contacts the target—its leading edge. Thereby, the efficiency of the ring airfoil for less lethal use is very much higher than for any conventional projectile.

The pockets formed in the M742tM743 ring airfoil gliders helped to meet the biophysical requirement of essentially zero lethality or injury, even for head impacts [goals based on anticipated use on minors during population control missions in the USA; a fallout requirement from the Kent State riots]. If the M743IM742 are launched as in the forgoing example at the same muzzle velocity as the sponge grenade the injury or lethality produced would be very greatly less than the sponge grenade. The M742 and M743 RAG projectiles were designed under very strict safety requirements—much stricter than today's automobile airbag criteria. It helped to meet the criteria to put the collapsible CS pocket section ahead of the center of longitudinal mass of the projectile; this limited the energy transfer to the target.

Although upon impact, flesh will not flow through the 'hollow' ring airfoil: it will "bulge" into the center opening. If looked at in section, this phenomenon deforms the flesh into a 'W' that stretches the skin and immediately subcutaneous tissues much more than the 'U' shaped deformation of a conventional rubber bullet like the sponge grenade. This 'W' deformation and stretching not only dissipates the energy of the projectile faster, than the 'U' shaped deformation, but more in the outer layers of flesh. In fact, the 'U' shaped deformation tends to transfer the energy deeper into the tissue which creates much more dangerous damage to vital tissues and organs. However, the 'W' shape creates a wider surface bruise than that produced by a conventional rubber bullet. This is good, as most of the body's pain receptors are in the skin and outer tissues.

Pain Phenomena:

A ring airfoil at the same energy level will produce more pain but less permanent or life threatening damage than a conventional projectile.

A simple demonstration of how the localized stretching and deformation of the flesh is more effective than a flat blunt blow can be readily made with everyday objects. An example of similar effects in producing pain is comparing the difference between a wooden mallet with a flat and smooth face compared with a mallet like used for meat tenderizing with a coarse pattern of serration on its face. If one experiments with both mallets by smartly striking each over a range of force and speed against the flesh on the forearm, the back of the hand, or palm it will be readily apparent that the serrated tenderizer type mallet produces more pain than the plain face mallet. One will notice that even with less force, i.e. energy, the serrated mallet produces more pain. The actual area of contact is less with the serrated mallet even when the mallets are the same diameter and the impacted area is the same for both mallets. The difference in pain production is due to both the increased localized deformation and associated stretching of the skin and the comparatively sharp points of the serrations compared to the smooth face and rounded edges of the blunt mallet, and because the points create higher unit point of contact pressure.

The skin and subcutaneous structures of the body contain most of the pain receptors in the body. Blunt blows which transfer energy into deeper tissues that are more critical to life and functioning of the body but not as effective at producing pain. Also, the pain receptors most efficient at producing pain need high unit pressures to achieve the maximum pain effect [this is why a prick with a needle can create a high level of pain even though a small area is affected].

Comparatively, the serrated mallet affects more pain receptors, and the higher level of pressure in the localized areas of the serrations stimulates the high level (pressure) pain receptors more effectively. Additionally, the sympathetic nervous system dilates the capillaries in the injured area further stretching the area thereby increasing the skin temperature; this causes more localized pressure and spreads over a wider area causing more receptors to be affected while allowing rejuvenation of the originally injured nerve ends to intensify the perceived pain. The ring airfoil performs like the serrated mallet. The ring airfoil allows for significant reduction in the mass of the projectile for the same effective area proportionally reducing any blunt trauma injury while increasing the pain effect. Achieving the maximum pain effect with the smooth mallet or conventional less lethal projectile will make for a severe or life threatening injury. Additions of an irritant such a 'pepper' or tear gas material can extend the effects of the stinging blow provided by a ring airfoil. It should be noted, the pain phenomena and functioning of the autonomic nervous system are the least understood of all the body's systems and strangely can produce the maximum pain perceivable when very small areas of the skin are stimulated, an example: a small sharp object which does not even penetrate the skin or really injure the body other than trivially can be very painful.

A good way of determining the maximum pain effect for a kinetic energy projectile weapon, while producing minimal injury, is the point where the skin's capillaries are just ruptured to produce a persisting red rash (on magnified inspection tiny blood blisters are produced in the area) with little or no damage to deep tissues. The M7321733 ring airfoils had their performance tailored to achieve this maximum pain point over their entire effective range-muzzle to 60 to 80 meters. [The rash is a ring shaped finely speckled red area corresponding to the contact area of the ring airfoil with the skin at the point of maximum stretching]. Conventional less lethal munitions like the M-1006 cannot achieve this type of effect as their energy dump rate is too slow and they cannot stimulate the high pressure pain receptors without having very high risk of killing or permanently injuring the target. Notably, the subject inventive ammunition can deliver the same effects as the original RAG M2321233 over a significantly greater effective range.

Other Specific Ring Airfoil Technologies

Miles C. Miller, while working for Mr. Flatau's group at ARL, developed an Expendable Launcher for Non-Lethal Ring Airfoil's using the M232 and M233 RAG projectile/gliders in the 1970's. This differed from the M234 launcher attachment for the M16A1 in that they are self contained. It was made of molded plastic material and was a disposable barrel and casing round, needing no launching tube or barrel. It was designed to clip onto a modified revolver which had its barrel and cylinder removed. The sabot slid on a central rifled rod with a cone shaped sabot stop on its end. Upon firing the sabot, holding the projectile, was pushed forward by the propelling gases. At the point the sabot's trailing edge cleared the casing and released the propelling gases the conical forward end of the central rod engaged the sabot, stopping it, causing the projectile to separate and travel down range. An excellent device limited in being very expensive to manufacture, by the need for a non-standard launcher or firing mechanism, and in its use of the U.S. Army's M232 and M233 RAG projectiles 1 gliders. However, it is representative and forerunner of most successful gas powered launcher which followed.

The NIJ, National Institute of Justice, part of the Federal Government's Justice Department, has funded private ventures to develop ring airfoil toys and police less lethal ring airfoil glider launcher mechanisms. These police weapons take the form of 65 mm gliders newly manufactured and based on the gliders of the original Army M7421743 ring airfoils. The weapons launching mechanism is similar to the above using the design engineering principle of simple inversion of the design, i.e.: the sabot is spun by grooves on its outer diameter mating with spiral grooves on an outer case's inner diameter and is stopped by a simple lip on the case forward edge with the propellant being a smokeless gunpowder. This design being nearly identical the present inventor's early ring airfoil launchers, wherein compressed air was the propellant, that were publicly demonstrated for The State of California Technology Transfer Commission of the Department of Prisons in the early 1990's.

Other earlier U.S. Army programs, from the early and mid-sixties, for Ring Airfoil grenade munitions demonstrate the vast improvements this technology has over conventional weapons. Mr. Flatau's group at ARL of the time developed two experimental munition RAG grenade ammunitions. The first was a 65 mm replacement for standard shoulder-fired 40 mm grenade ammunition which improved the effective 'kill' radius of a standard grenade round by about SO %, while significantly improving a shoulder-fired grenade's effective range. Interestingly, the second was a 40 mm replacement for the M406 round—although, this too required a new launcher/barrel due to the stabilization spin rate difference over convention projectiles. This round had the same 'kill' radius of the standard M406 round but increased its effective range, shoulder-fired, from around 400 meters to over 1400 meters. With this last performance achieved at a lower loft than needed for the M406's 400 meter range. A direct comparison is at 400 meters the M39 system (M79 shoulder launcher and M406 round) needed an elevation angle of 39" with the RAG munition needing only 6" elevation to achieve the 1400 meters. Both of these were very simple ammunition rounds for a basically conventional gun with a special rifling pitch and had pusher sabots friction separated from the ring airfoil in flight.

Supersonic lethal tubular projectiles have been developed. These came from the earliest ideas proposed by Mr. Flatau and he and various associated are still quite active in the field. However, such devices are very critical to design and manufacture and have limited uses. These devices are usually in the form of replacement ammunition for conventional small caliber hand and long guns intended to be extraordinarily lethal over conventional ammunition. They are similar to the very early rounds and use pusher sabots which are fiction aerodynamically separated. The supersonic ring airfoil does not have as significant lift generating capability as the larger caliber subsonic non-lethal or less lethal projectiles, and therefore, is of limited improvement over conventional projectiles. And, they are usually intended for producing lethal wounds by limited penetration of the body combined with a very fast energy transfer dump resulting in very nasty gunshot wounds.

On the other end of the spectrum are the ring airfoil toys. This technology lends itself to the 'toy gun' field due to the inherent safety provided and the excellent range provided. Toys typically use a thin rubber, plastic or thicker foam ring and usually dispense with functional airfoil shape to save on cost as ultimate performance is not the issue but fun. Generally, a spring loaded (either steel or rubber) sled mechanism riding on a spiral groove track with a stop to stop the sled and separate the ring airfoil to flight is used. Some take the form of a throw toy designed to be hand thrown by either flipping it off the hand at the end of the throw to create some spin stabilization or with a tail mechanism used to both throw and aerodynamically stabilize the ring. In general other than the throw types, the primary objects of the toys are unique and enticing style and various repeating mechanisms or combination of several launching mechanism into one 'gun' to provide for repeat shots.

Figure 1C:
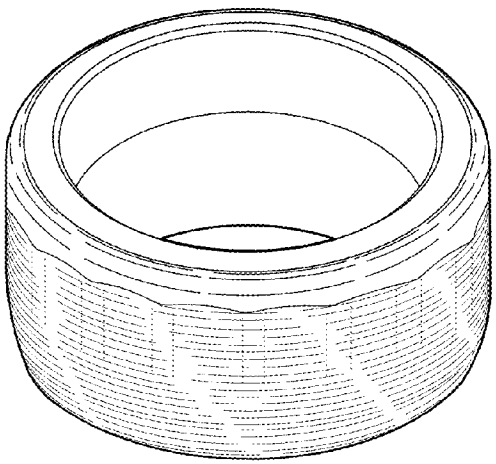
FIG. 1C illustrates a forward side isometric view of U.S. Army M743 Sting RAG for Kinetic Energy delivery only.
Figure 1B:
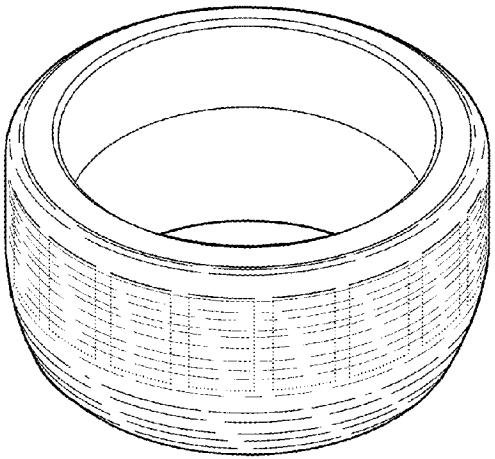
FIG. 1B illustrates a forward side isometric view of U.S. Army M742 Soft RAG for CS tear gas and Kinetic Energy delivery from the 1970's.
Figure 1A:
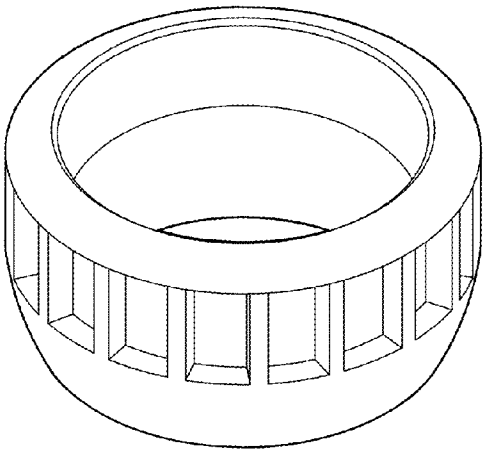
FIG. 1A illustrates a forward side isometric view of U.S. Army RAG M742/M73 basic rubber molding showing molded pocket from the 1970's.

| Reference Numerals Used in the Drawings: | |
|---|---|
| 1 | ring airfoil glider expendable cartridge |
| 2 | cartridge case base |
| 3 | primer holder |
| 4 | primer |
| 5 | propellant cup |
| 6 | propellant |
| 7 | combustion chamber |
| 8 | primary gas vent |
| 9 | sabot guide |
| 10 | rifling |
| 11 | rim |
| 12 | rim groove |
| 13 | cylindrical section |
| 14 | lip |
| 15 | sabot |
| 16 | central passage |
| 17 | bearing body |
| 18 | alignment groove |
| 19 | sabot ring |
| 20 | cover groove |
| 21 | bond line |
| 22 | secondary gas vent |
| 23 | glider dimple |
| 24 | cover dimple |
| 25 | scoring |
| 26 | pedaled surface |
| 27 | circular contact projection |
| 28 | ring airfoil glider |
| 29 | leading edge |

-continued

| Reference Numerals Used in the Drawings: | |
|---|---|
| 30 | tailing edge |
| 31 | cover dimple |
| 32 | payload cavity |
| 33 | cavity hinge |
| 34 | siren groove |
| 35 | glider dimples |
| 36 | barrel |
| 37 | chamber |
| 38 | bore |
| 39 | firing and breech mechanism |
| 40 | cover |
| 41 | priming passage |
| 42 | turbulent boundary layer |

DESCRIPTION OF THE PREFERRED EMBODIMENT

Momentum and Energy:

At this point a time out is necessary to explain the differences between momentum and energy effects of a projectile and how they relate to the human vulnerability rating of that projectile. It took several hundred years for some of the great minds in physics such as Galileo and Newton to develop an accurate intuitive understanding and analytical means to describe the quantitative of the simple laws of nature. Simple as they are, most of us sometimes have a hard time grasping the quantitative knowledge and understanding. We usually function in our understanding more along the lines of the intuitive Aristotelian view. To begin with, movement is defined quantitatively as velocity. Velocity is distance divided by time. Velocity or movement is how long it takes to go a certain distance.

Newton's law of conservation of momentum is that the momentum of moving body is conserved when that body strikes another body. Momentum is defined as the mass times the velocity. It only relates to moving mass. Maybe the best way of defining it for our purposes; momentum is the property of a moving body that determines the length of time required to bring it to rest. In collisions between a projectile and a human, it describes the effect that pushes or moves the person. It is the effect that shoves your shoulder back when firing a gun or when a projectile hits you that moves your body. It is impossible for a shoulder fired weapon to knock a person over without knocking the shooter over also; cases of the person targeted losing balance are cases of shock and muscle contractions causing one to fall down from the impact—not momentum effects.

Momentum is the movement of a body directly resulting from an impact. Momentum does not tear tissues, produce friction, and a heating effect in tissues: only shoves or moves them. Newton describes kinetic energy as the velocity squared times the mass. Energy is power or the capacity to do work. Kinetic energy is that stored in a moving body. Energy tears tissues, produces a heating effect due to friction, produces pain, and in general produces the damage, i.e. work, caused by an impact. The energy of a projectile is conserved in an impact with another body by changing the energy of motion of the projectile to the energy of motion of the impacted body if it develops movement, any heat energy, and work or physical changes in the body like deformation or other damage. Basically, if one is injured by the impact of a projectile it is the kinetic energy that injures. It is the effect that 'hurts' your shoulder when firing a gun or when a projectile hits you. As with momentum, energy is always conserved.

Any moving body or projectile has both momentum and kinetic energy.

It is many times not obvious really what the difference between energy and momentum is, particularly, when one is dealing with projectiles hitting people. This difference can best be understood when the terms elastic and inelastic are applied to a collision. In perfectly elastic collisions the momentum and kinetic energy directly transfer and there are no losses due to deformation or heating effects due to friction. This never happens in nature; a ball never bounces as high as it is dropped, no matter what is made of or dropped on. Basically, inelastic collisions cause deformation and heating of the bodies involved, reducing their kinetic energy; some of the ball's energy is changed into heat when it hits the floor—the real world. And, as it takes time to deform the ball the total velocity is reduced to conserve the systems momentum. In developing ring airfoil ammunition I routinely used a back-drop projectile catcher made up of three golf practice range nets hung from a horizontal bar with their lower edges free. If heavy and light projectiles at the same kinetic energy level, with the heavy projectile having much higher momentum, are stopped by the nets something instructive happens:

When nets catch a heavy and slow moving projectile they always are moved back forming a very deep cone shaped depression several feet deep, as they stop the projectile.

Conversely, when the nets catch a light but fast moving projectile they are only pushed back a few inches.

This difference is due to the momentum effects difference. However, a very fast light projectile may break and tear some cords in the netting, damaging it, while the heavy projectile leaves the netting undamaged. Remember, both types of projectiles hit the exact same medium with the same resistance and strength. This discussion will help in understanding the human effects of projectiles.

From long and expensive human vulnerability research including animal experiments, it has been determined that:

A non-penetrating projectile impacting flesh is called a blunt trauma producer.

Kinetic energy does the damage-tears tissues, ruptures blood vessels, breaks bones, and the like—it is what is dangerous.

Momentum is 'felt' as a shove and does not in of itself injure.

Injury from a non-penetrating projectile proceeds in an interesting way, it effected by how deep the deformation from the projectile travels. This is not like a 'shock, or more precisely, pressure wave' as is seen in skull impacts, wherein, the wave travels deep into the fluid filled brain cavity. These 'wave' effects do damage and injure and are produced by the kinetic energy of the projectile. The depth of the deformation is due to movement of the tissues by the projectiles momentum. During the time the deformation is formed in the tissue, the stretching, tearing, and rupture of the underlying tissues dissipates kinetic energy. Simply, a deeper deformation drives the injury producing damage deeper into the body structure, wherein the vital organs/tissues reside. For an equal diameter and kinetic energy level a heavier projectile will damage tissues more deeply than a light one. All things being equal a light projectile results in a shallower injury zone than a heavy one. Although, the overall damage to tissues may be equal. Another way of explaining this is in terms of energy transfer 'rate', i.e. how quickly the energy is transferred, remember; momentum is the property of a moving body that determines the length of time required to bring it to rest. The longer the time it takes to stop the projectile the more the tissue will be deformed. Generally all things being equal, for the same kinetic energy level, a heavier projectile takes longer to stop than a light one, meaning; he heavy projectile will deform deeper into a given tissue than a light one.

Sometimes, a deformable projectile nose is used to limit the injury produced by a nonpenetrating projectile. The M1006 sponge grenade was designed with this in mind. The M7431742 RAG also had a deformable front section, not intentionally, simply a side benefit of the CS pockets. If the projectile's deformable section is 'softer' than, or preferably equal in resilience to, the body tissue encountered this works to limit injury in two ways:

By dissipating the kinetic energy in the projectile due to its deformation, turning the kinetic energy to heat, like happens when a rubber ball is bounced on the floor.

By increasing the time (decreasing the rate) the energy is dissipated to the tissues. The projectile does part of the deformation to limit the depth of deformation of the tissue.

Usually, it is very hard to have this deformation effect with soft non-penetrating projectiles to spread the energy in a direction perpendicular to the direction of impact. If the projectile nose is softer than or of equal resilience to the impacted tissue, it would not have sufficient structural integrity to transfer much energy through cantilever action of the projectile nose. The deformed or cantilevered part of the projectile would have to have sufficient mass to basically rearrange the mass distribution of the projectile perpendicular to its direction of travel Improvements in Effectiveness with Low Risk Presented by the Rag Technology As just stated but worth repeating:

The ring airfoil allows for significant reduction in the mass of the projectile for the same effective area proportionally reducing any blunt trauma injury while increasing the pain effect. Additions of an irritant such a 'pepper' or tear gas material can extend the effects of the stinging blow provided by a ring airfoil.

The target muzzle kinetic energy level for the RAGALL, the object invention, is an arbitrary goal based on the M-1006 Sponge Grenade's performance at 'safe' engagement range of 20 meters (73 meters/sec with a 35 gram projectile and 93.3 joules at 20 meters and with the typical 10% area increase allowed for the 'expanding' sponge grenade. Using this performance adapted through the data and models developed for the *Handbook of Human Vulnerability* by the U.S. Army resulted in the 40 rnrn RAGALL performance target. This made the RAGALL's target a velocity of 128 meters/second with a non-expanding 11 gram glider with 84 joules at the muzzle. This was a very conservative equivalent 'handbook' human vulnerability safety performance goal. It does not take into account for the RAG the w-shaped energy dissipation; the fact that the data generated for the handbook's models was based on 40 gram and heavier 40 mm projectiles and may not be appropriate for projectiles nearing ¼ that mass; and the unit pressure available for production of pain in the 'high' range pain receptors provided by the RAG. Therefore, it is not an equivalent performance in any way, only in safety by the standard human vulnerability lethality rating techniques. In pain production/deterrence factor/terminal effects, human vulnerability performance and ballistic performance categories the RAG is much superior, for example: the velocity degrade of the RAGALL glider is 3 meters/sec over 50 meters compared to the M-1006 Sponge Grenade projectile degrading 21 meters/sec over 50 meters distance.

Be this as it may, it is not taking advantage of the less lethal or non-lethal and efficiency possibilities presented by the ring airfoil. If the above example for the RAG is changed so that terminal performance as far as deterrence factor or pain produced is maximized for the target but where the goal is not to exceed the maximum pain perceivable, the RAGALL with an 11 gram glider can be made significantly safer. In engineering, this would be maximizing the efficiency of the system and would be more appropriate use of the technology. The original goal could then just be used as a maximum performance possible limit for the development program. At maximum efficiency, the muzzle velocity of the RAGALL with an 11 gram glider would be 90 meters/sec with 44.6 joules energy. At this performance level, it would have equivalent human vulnerability ratings as the original M232IM233 RAG, making it very safe while not degrading the range or target effect capabilities desired.

It well may be proven that even lighter or less dense ring airfoil glider projectiles may be even more efficient at producing deterrent effect. As mentioned previously, the 11 gram glider is most likely outside the spectrum covered by the currently accepted human vulnerability models. Although outside the original development program for the RAGALL, it was discovered that very light projectiles did not perform within the 'handbook' models like 'traditional' blunt trauma projectile technology. Some, at energy levels used by the RAGALL, it would perform with little if any depth of effect. Some research directed in the area of human vulnerability effects of very low mass projectile may prove to yield a large return in less or non lethal performance for kinetic energy delivery systems.

Powdered projectiles for either simple painful blows or delivery of a tear gas or pepper irritant warheads could be the most efficient means of translating the ring airfoil glider's kinetic energy to safe but maximally effective deterrence of a target.

Operational Possibilities Presented by RAG Technology

The original tactical or operational requirement for the non-lethal RAG developed in the 1970's was for high levels of first round hit probability on individuals and small groups out to 60 meters distance. This allowed for targeting the 'trouble makers' in a riot or crowd without causing extraneous causalities. This goal assumed that the crowd was not armed [from the Kent State riots] and was an American civilian group. This is not the mission for the United States Military and is why the original 65 mm RAG had no real place in military use outside of the highly interested Israeli and some European militaries. [The State Department shut down the attempts to transfer the material and technology, and the civil police agencies did not have the M16A1, at the time. Of course now the M233 inventory has exceeded their useful life and are slated for eventual disposal by Rock Island Arsenal].

For less lethal operations the ring airfoil glider allows for targeting point and small area targets at ranges of up to 100 to 200 meters, depending on design, loading, and launcher [125 to 150 meters is a practical effective range, for point targets, and is at the limits of what soldiers under pressure can successfully target]. RAG technology may be used for targeting an area target like a mob by the use of a salvo round and/or automatic machine gun type launcher. The strength of RAG technology is meeting these goals of deterrence with less likelihood of producing serious or life threatening injury than conventional less lethal ammunition rounds.

To this end, an interesting and valuable discovery came from the work on the present invention's preferred embodiment 40 mm RAGALL round would enhance the operational effectiveness of ring airfoil gliders. It was found the ring airfoil glider could create a siren like howling sound in the direction of travel; strangely, this sound is not heard at the firing position. This is a 'banshee like scream' that makes it hard to stay put and not run when the ring airfoil glider is fired over one's head. This effect can be either created or eliminated easily by simply modifying the ring airfoil glider's configuration. Surprisingly, this sound energy does not measurably degrade the kinetic energy of the ring airfoil glider. This sound effect could be used to help dissipate a crowd by firing over their heads or when a few rounds were directed at the selected inciting individuals.

The sound effect can be enhanced when combined with a spiral or corkscrew flight path of a ring airfoil glider. Usually, this flight pattern is a fault of a glider's flight path caused when either separation from the sabot is inconsistent or when the propelling gases are allowed to impinge on the glider directly. These defective launch conditions cause the glider to become canted in relation to its travel direction making it wobble like a child's top or play gyroscope. In investigation of this phenomenon, a mechanism was developed to reproduce a spiral or corkscrew flight path. The diameter of the spiral can be controlled to produce a desired and constant spiral diameter. Practical or useable diameters are in the range of between 0.25 to 2 meters. Larger spirals easily made but are less practical. The corkscrew flight path when combined with a multiple projectile round would significantly increase the hit probability in the field. Also, a 1 to 1.5 meter diameter spiral combined with the banshee sound is very intimidating as the sound varies and makes location of the precise direction of the glider difficult. Personnel standing down range are simply not able to stand their ground.

This sound effect enhances the increased range tactical advantage of the ring airfoil, particularly in peacekeeping missions in 'dangerous and armed populations'. Certainly, in all military endeavors the goal is to 'win' with the least actual combat. Therefore, the ring airfoil provides a large benefit by helping to maintain a safe perimeter or separation distance between the peacekeepers and the population. Although, less lethal ring airfoil gliders cannot accurately target at ranges beyond 200 meters, they can be an effective deterrent against incursions into the danger space of small arms to at least 300 meters. The preferred launcher for maintaining a safety perimeter would be a machine gun type automatic launcher like the Mark 19.

The need for launching ring airfoil gliders has always lead to the need for a special gun, launching attachment, launching mechanism which has limited its success and widespread acceptance due to logistic problems associated with the procurement and fielding of a new weapon for a relatively special purpose. This applies equally to military and police forces. Therefore, the ability to use less lethal ring airfoil gliders in a replacement disposable ammunition round for standard and existing weapons is the most logical course of implementation of this advanced projectile technology.

Notably in closing out discussion of tactical situations, if the other side is using rocks and slings the ring airfoil provides the only less lethal solution for projectile based weapons. Rocks either thrown or slung are deadly and can be quite accurate out to 100 meters, easily out distancing current issue less lethal projectiles. At distances of up to 200 meters rocks and slings lose their accuracy but retain the possibility of producing serious or deadly injury.

In consideration of all the above, a ring airfoil glider having a true and constant balance of aerodynamic, gyroscopic, and gravity forces creates a projectile with unmatched flatness of trajectory. Such a glider projectile's combat hit probabilities are greater than any comparable ballistic-projectile-based weapon. At the same time, the effective range of less lethal ammunition will be greatly enhanced. Additionally, the terminal effects will be much less dangerous while producing more deterrent pain. Most importantly, it is necessary for the ring airfoil glider to be able to be launched from conventional guns in the form of replacement disposable ammunition. I believe these goals have been accomplished with my Ring Airfoil Glider Expendable Cartridge Ammunition, Ring Airfoil Glider and Glider Launching Method and its preferred embodiment the 40 mm RAGALL.

Fundamentals, Art and Technology of Successful Launching Ring Airfoil Gliders

In general, most less lethal ring airfoil glider projectiles and ammunition have been based upon the Army's M7421743 projectile and has maintained the original 65 mm diameter and an associated need for a special purpose launching mechanism. From the time of the Army's, i.e. Mr. Flatau's, earliest work certain fundamentals have been necessary for the successful operation of ring airfoil gliders. And, the present inventor has considered, experimented with and observed many other forms of basic ring airfoil or tubular projectile technology, wherein this prior art, fundamentals and details relating to the current invention are generally related as follows:

First there are two basic means of stabilization of ring airfoil glider/projectiles: spin stabilization by creating a gyroscopic force and aerodynamic stabilization. In aerodynamic stabilization some form of tail or drag producing mechanism is located behind the center of mass to create friction drag in the air to orient the projectile to the direction of travel. In this case, the glider usually follows a more or less traditional ballistic path as the projectile is always oriented to the direction of travel, like a bullet: points or is axially coincident with the vector of its motion. Some hand thrown toys have been designed this way. The limitation of the aerodynamic method is that to create a true lifting flight path, like a glider, is difficult and requires the use of tail that can elevate or cant the device against the force of gravity taking into account the launching orientation.

Spin stabilization can make the ring airfoil into a flying wing without a tail. If the spin rate is just adequate to stabilize the ring airfoil the device by in large behaves like a tradition projectile-always pointing or aligned in the direction of its motion. This provides the device the advantage of lower drag than a similarly sized solid or conventional projectile and thereby less velocity degrade with a slightly flatter trajectory—due to lessened flight time.

For the ring airfoil to function as a lifting body, the spin rate of the glider must be sufficient to maintain the original attitude of the glider at launch so that the glider generates a pitch change or asymmetric airflow over the wing as it falls to generate an opposing lift against gravity, i.e.: maintains its launch orientation as its motion vector changes due to the force of gravity and velocity degrade due to aerodynamic drag-gyroscopic stabilization. This in the case of the M7421743 65 mm diameter and 35 grams mass glider is a range of about 4500 to 5000 rpm for speeds around 0.2 Mach. This narrow range is primarily due to the unbalance or differential in location of the aerodynamic center of pressure and the center of the gliders masses centrifugal force: necessary to maintain a straight flight path. In the case of the 40 mm RAGALL, the preferred embodiment of this invention, with gliders of between 10 to 15 grams mass the spin rate is in the range of 20,000 to 50,000 rpm depending on glider design for launch velocity up to 0.5 Mach. But in this case, as the aerodynamic center of pressure and center of the centrifugal forces acting on the mass are coincident, the range is wider and with spin rates in excess of the 100,000 rpm possible—producing a very high degree of gyroscopic stabilization. As to glider airfoil shape, most any airfoil shape is useable but will affect the minimum spin rate needed to achieve gyroscopic stability, generally; the higher the drag characteristics and smaller the diameter the higher spin rate required to achieve gyroscopic stabilization. Gliders with airfoil sections creating a significant venturi effect in the center of the device have high aerodynamic drag and should be avoided. Ultimately, spin rate must be based on experimentation due to the difficulty in prediction of the aerodynamic center of pressure and drag forces on the spinning glider in flight. The spin is usually created by the action of rifling to develop an angular or rotary force on the glider from its lineal forward movement as it is accelerated during launch. This may be accomplished by directly bearing of the rifling on the glider or indirectly by the use of a sabot or sled intermediary mechanism. Interestingly, Mr. Flatau and his group at the Edgewood Research and Development Center for the U.S. Army used a launcher barrel device which was spun by an electric motor for launching ring airfoils as a tester to study spin rate.

Gyroscopic stabilized ring airfoil gliders, like other glider type or non-powered lifting devices, do not respond well to large or steep angles of attack. Therefore, increasing the loft angle beyond about 10" above horizontal [the maximum angle depends on ring airfoil's design] does not increase the distance the ring airfoil glider will travel, as is the case with conventional projectiles like grenades and artillery.

Secondly, there are four basic means of propelling a ring airfoil glider/projectile: hand thrown, spring, expanding a gas and electro-magnetic. Hand thrown devices are usually limited to the toy classification. They can be simple rings, normally simple short tubes, hand thrown with a snap of the wrist, and if the mass is very low and the diameter rather large they can become gliders rather than simple tubular projectiles. Aerodynamic or tail stabilized hand thrown devices are more complex and usually are more like projectiles such as arrows rather than gliders. Spring launched ring airfoils use various bow and string mechanisms, resilient cords or coiled metallic springs, and due to the limited storage of energy of the spring are used mainly for toys. Commonly, a sled of some type sliding on a spiral grooved track or rod is used to impart a spin to stabilize the ring airfoil. Some retaining and release mechanism is provided to hold the sled in battery until the one desires to launch the ring airfoil. The spiral grooved rod may even be attached to cup holding the ring airfoil and be the sled pushing the device. Usually the sled is impeded by a stop to launch the ring airfoil.

Expansion of a gas either stored and released or generated from a propellant charge is the most common method of propelling a ring airfoil. The most practical means is with the gas expanded in a closed chamber to push the ring airfoil. The complication over conventional gun technology is the need to seal the hole in the center of the ring. A central rod or mandrill located in an outer tube wherein the tube and/or the rod being rifled to impart spin directly to the ring airfoil is the simplest method where the propellant gas directly pushes on the ring airfoil in an annular barrel. Sabots and sleds have been applied to seal the gas with and without the central rod along with rifling of the rod and/or outer tube. Some means of channeling the gas behind the device is made use of as well as a way of storage and release or generating the gas. These closed chamber gas powered devices may be found a complete self-contained launcher or as cartridge ammunition for use in a gun mechanism.

Jets of gas or rocket propulsion has been tried where the gas is stored and released or generated most often in the sabot/sled mechanism or less practically but simpler in concept in the ring airfoil itself. Both aerodynamic and spin stabilized means are used. This propulsion can be easily adapted to the simple rod tracked sabot or cup launcher like used for toys.

Most practical is the use of a traveling charge attached to a sabot pusher device within a launch tube with rifling providing the spin. Actually self powered ring airfoils, and in particular spin stabilized types, can to be difficult to accurately direct and find their best function as fireworks or toys.

Some ring airfoil devises have propeller like blades around their perimeter and use a gas or rocket jet to rotate and propel themselves forward by the trust developed by the propeller blades. One device had fan blades in the center of the ring for providing propelling thrust as the devise rotated. The ring airfoil can also be propelled by electro-magnetic means as is used by 'rail guns' but this means finds no current application.

The transition from the launching or gliding mechanism to flight is an important aspect of launching ring airfoils, if not the most important. Transition can be in three basic forms by basic engineering methodologies simple release, friction and plastic deformation. Simple release is easily understood: In hand throws, jet/rocket self-propelled and electromagnetic launching means the mechanism is simple release of the ring airfoil as no sabot or sled is need to hold the ring airfoil.

However, friction and plastic deformation are not usually understood but can be defined as follows:

Friction release refers to the use of differential friction or the difference in drag created on the launching sled or sabot and the ring airfoil by either airflow when in free flight or a braking mechanism provide by the launcher design.

Plastic deformation refers to the use of a stop or means of deforming the material of either the traveling launching sled or sabot and/or the launcher mechanism, such as a stop lip or ramp as the material of the stopping mechanism is deformed [no matter how minutely or whether or not it recovers its original form] in absorbing the energy of the sled or sabot to separate it from the ring airfoil and sometimes completely stop or capture it.

In spring propulsion, a sled or sabot is most likely used with a means must be made to separate the sled from the ring airfoil. This separation mechanism can take two basic forms by friction or plastic deformation. Friction involves either a braking mechanism built into the launcher or differential drag between the ring airfoil and the sled or sabot due to airflow. The sled or sabot is decelerated in comparison the ring airfoil, and must cleanly without disrupting the ring airfoil's flight separate from it: may either be retained by the launcher or simply fall away from the ring airfoil. A stop may be provided for the sled or sabot to separate the same from the ring airfoil; the stop functions by plastic deformation but may use a resilient material so the deformation is not permanent. It is important that the ring airfoil does not have a wobble induced upon transition to flight as when it is spin stabilized it can develop a corkscrew or uncontrolled flight path, usually a fault. A captured gas spring cylinder or bellows is simply a version of the basic spring means of propulsion.

In the forgoing, the complication of an escaping gas is not present which is a factor that can seriously complicate the ring airfoil's transition to flight by inducing wobble. [This wobble is caused by the gas escaping past the ring airfoil upon transition to flight, i.e.; the propelling gas upon release is traveling faster than the ring airfoil and causes it to 'fly backwards' for a moment, disrupting its balance and causing wobble.] Wobble results in a limit cycle due to the angular deflection and time period of the wobble and the velocity of the ring airfoil interacting to produce a spiral flight path. The trouble is that it wobble is not predictable due to the happenstance of the reverse gas flow condition at launch, and therefore, the spiral flight path can be a corkscrew varying in diameter hardly perceivable to many feet in diameter—not good.] Gas propulsion of the piston type, like a conventional bulleted disposable cartridge and gun, can use the same means as the spring propulsion for transitioning the ring airfoil to flight, i.e. friction and plastic deformation.

Invention Object and Advantages

Figure 2A:
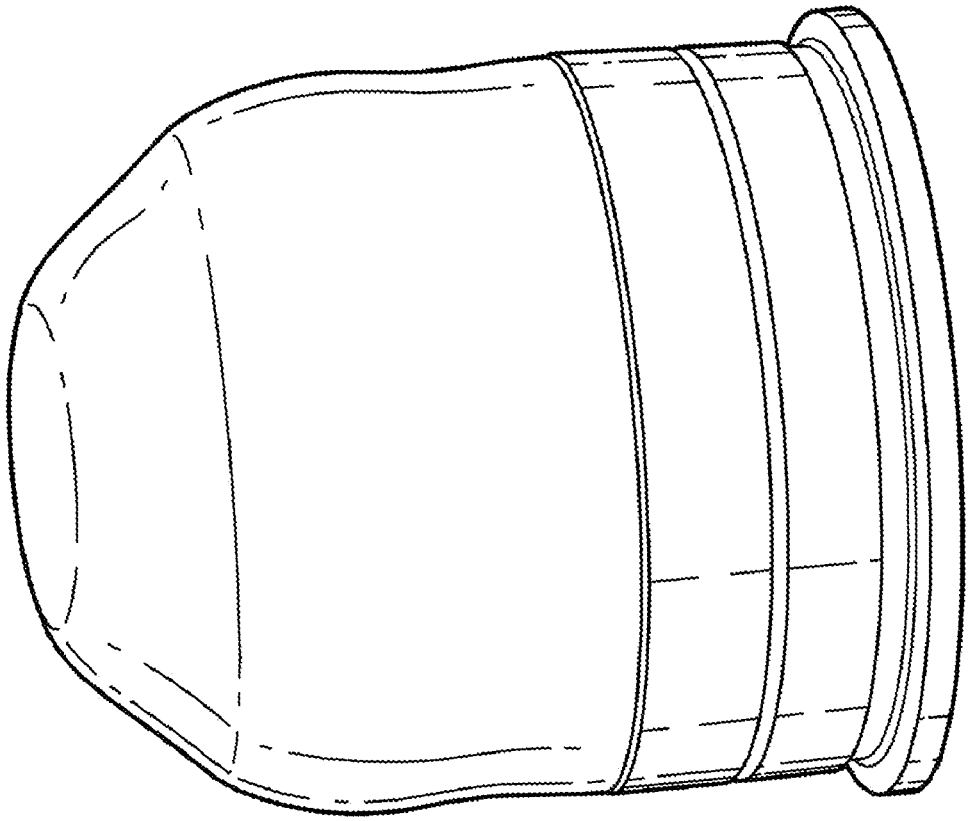
FIG. 2*a* illustrates a side isometric view of the Ring Airfoil Glider Expendable Cartridge Ammunition, 40 mm Size.

My Ring Airfoil Glider Expendable Cartridge Ammunition, Ring Airfoil Glider and Glider Launching Method in its preferred embodiment is named the 40 mm RAGALL (Ring Airfoil Glider Less Lethal). Technically, the RAGALL-2 is a caseless round with a unique cycle of operation. This is in part due the necessities of launching a ring airfoil glider and part due to achieve the maxim for all military small arms ammunition—it must be producible for the minimum cost possible; It is an incredibly significant leap in the performance of any current kinetic energy less lethal round, and represents the 'state of the art'. FIG. 2*a* illustrates a side isometric perspective view of the inventive Ring Airfoil Glider Expendable Cartridge in 40 mm size. It is able to deliver a pepper or other irritant and/or a marker dye along with pain of a 'safe' kinetic energy impact. This improved effect glider/projectile will significantly improve its nonlethal combat effectiveness over just a kinetic energy blow. Additionally, an improved effect glider/projectile ability to produce a siren like howl as it flies through the air toward the target will intimidate and discourage the opposing force. Importantly, the invention allows the use of disposable special purpose ring airfoil ammunition in standard guns and projectile launchers. Previously, to launch a ring airfoil glider required a special purpose gun, barrel or other mechanism due to the need for significantly different projectile spin rates needed by the ring airfoil over convention projectiles; due to the need to seal the hole in the center of the ring airfoil projectile, and; the need to cleanly and without disruption separate the ring airfoil from the launchers projectile holder sled or sabot mechanism.

The preferred 40 mm size Ring Airfoil Glider Expendable Cartridge Ammunition, Ring Airfoil Glider and Glider Launching Method may be used in the M-203 grenade launcher and when used with an auxiliary cartridge telescoping cartridge case, such as developed by Frank Dindl at the U.S. Army's TECOM-ARDEC group at Picatinny Arsenal, it is applicable for use in the Mark-19 automatic grenade launcher. The preferred embodiment Ring Airfoil Glider Expendable Cartridge is under 48 mm in length, weighs 45 grams or less (depending on projectile), and launches a 40 mm ring airfoil glider. It is adaptable to other sizes such as 37 mm diameter gliders, allowing it to be used in police riot control equipment such as rubber bullet and gas guns. Multiple simultaneous ring airfoil gliders may be stacked axially in the payload cavity to provide salvo capability. It is preferably completely made of thermoplastic material, and all its component parts can be injection molded. The performance was originally selected to provide a slightly lower kinetic energy and significantly a less life threatening injury at its muzzle velocity as the current 40 mm M1006 Sponge Grenade provides at 20 meters down range. Other performances are easily accommodated, and maybe preferable, for specific applications. The basic design can be modified for other diametrical sizes of projectiles. Typically, projectiles of between 10 and 14 grams are used for the 40 mm diameter. The typical designated muzzle velocity is 90 to 130 meters per second depending on the projectile and loading selected. A disposable sabot is used and exits the muzzle separated from the projectile and has approximately $1/5^{th}$ the projectile's energy and has significantly less mass. The separation of the ring airfoil and sabot is by a unique application of the friction principle using the gun barrel's bore to by parasitic sliding friction against the sabot to both provide for clean separation and slow the sabot to a safe energy level upon exit—quite the opposite function for which a barrel is normally used, i.e. accelerate the sabot and projectile. Shortly after exit of the muzzle, the sabot is designed to cause the same 'w' shaped deformation in flesh produced by the actual ring airfoil glider. The sabot is very safe, and is designed to travel 20 meters downrange before dropping to the ground. This provides the ability to safely fire over friendly troops. Typically, at 100 meters/second a 40 mm diameter and 12 grams mass Ring Airfoil Glider over a distance of 50 meters: the trajectory height is less than 0.13 meters with a velocity degrade of less than 3.0 meters per second.

When used in the M203 grenade launcher attached to the M-16 rifle, the rifle's sights can be used to aim the ring airfoil glider due to the Ring Airfoil Glider Expendable Cartridge round's flat trajectory and improved hit probability. The effectiveness of the man/weapon system is improved by elimination of the need to reacquire a sight picture on the target when switching between less lethal (M-203 with the inventive Ring Airfoil Glider Expendable Cartridge ammo) and lethal force provided by the M-16A2 and the 5.56 mm round. With a little practice, the shooter should be able to hit the target as reliably with the glider as with a bullet.

Figure 2B:
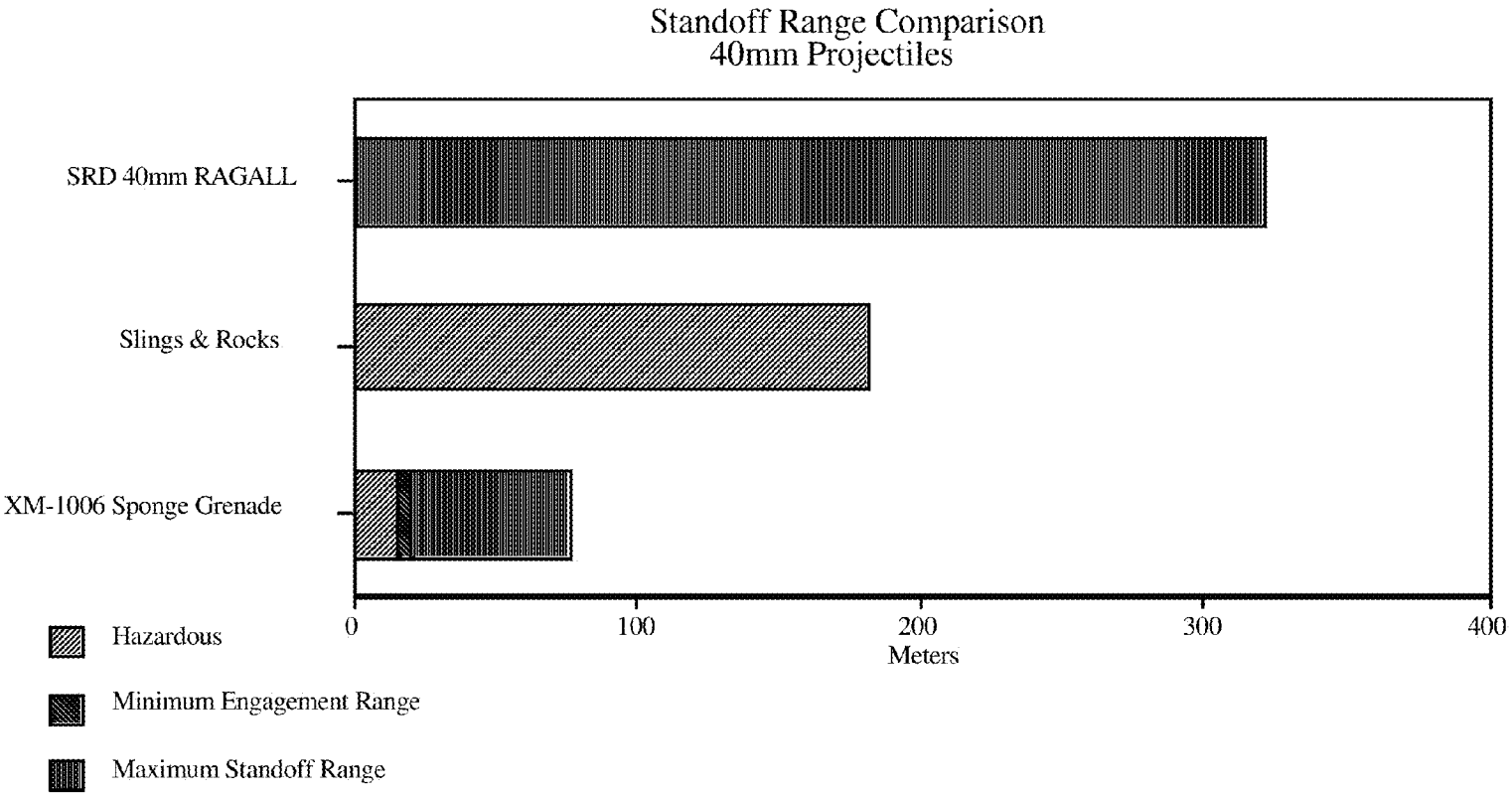
FIG. 2*b* is a comparison of various 40 mm projectile stand-off ranges.

A typical comparison of less lethal 40 mm size grenade launched less lethal projectiles with slings and rocks is depicted in FIG. 2*b*, although, the 40 mm Ring Airfoil Glider Expendable Cartridge (also referred to as the SRD 40 mm RAGALL) has a much lower (actually trivial) departure angle:

The comparison in FIG. 2*b* to the present M-1006 Sponge Grenade round is made with the RAGALL limited to muzzle energy slightly less than the energy of the Sponge Grenade at a safe engagement range.

The SRD 40 mm RAGALL has a glider/projectile of very low mass compared to current 'rubber bullet rounds' (currently projectiles are 10-14 grams). Its low mass contributes to transferring its energy in the surface layers of flesh. It takes the concept of using a 'light' low density projectile for less lethal kinetic energy delivery devices to a place previously not thought practical. Significantly, it has a mass of $\frac{1}{3}^{rd}$ typically used in either the original M232 1 M233 RAG or current M1006 Sponge grenade round. Even at higher velocity, this produces much less momentum and a shallower deformation of the flesh. This is combined with the mechanism of creating the 'W' shaped deformation, as previously explained herein. Therefore, kinetic energy is transferred more in the outer layers of the body. As most of body's pain receptors lie in the skin and outer layers, the SRD 40 mm RAGALL produces more deterrent pain with less dangerous injury than other kinetic energy rounds. In fact, the current models for blunt trauma injury may need reconsideration.

In summary, my Ring Airfoil Glider Expendable Cartridge Ammunition, Ring Airfoil Glider and Glider Launching Method provides the infantry soldier a means of imposing order over the wide range of tactical situations he faces in modem non-traditional combat. This 40 mm substitute ammunition very significantly extends the distance at which a blow equivalent to the hand or fist may be delivered. A payload of an irritant agent, olfaction agent, and/or marker dye may greatly enhance the effectiveness of the ammunition. The preferred SRD 40 mm RAGALL can be fired from existing 40 mm grenade launchers, such as the M203 launcher, mounted on his MI6 small arm weapon. It is designed for minimum complexity, weight, and cost of procurement. It will significantly exceed the hoped-for 0 to 100 meter less lethal capability for traditional 'rubber bullet' technology desired for military operations. In the preferred embodiment my Ring Airfoil Glider Expendable Cartridge Ammunition, Ring Airfoil Glider and Glider Launching Method is superior to present blunt trauma ammunition, used in non lethal or less lethal tactical operations, providing object and advantages in:

- Ability to be used in conventional existing guns and grenade launchers
- Ability to fly ring airfoil glider through a tube or rifled gun bore
- Ability to stabilize flight of glider in bore of launcher through creation of a peripheral boundary cushion of air between the bore internal diameter and the external diameter of the ring airfoil glider
- Accuracy: an order of magnitude improved hit probability
- Flatness of trajectory: 115'~ or less the trajectory of conventional projectiles
- Constancy of biophysical effects: 5× as consistent in human effects
- Adequacy of deterrent effects: 3× with superior
- Reduced cost of procurement due to simplified manufacturing methods such as injection molding
- Deliver a safe blow if the sabot accidentally hits someone nearby
- Selectively deliver a payload to the target such as an irritant, marker dye, or olfactant agent
- Create a siren like noise to intimidate opposing forces as it flies through the air
- Ability to be launched from automatic type gun mechanisms by the use of an auxiliary telescoping cartridge case mechanism
- And, other objects and advantages will become apparent over time in the application of my invention.

Physical Description, Invention: Ring Airfoil Glider Expendable Cartridge

Figure 3:
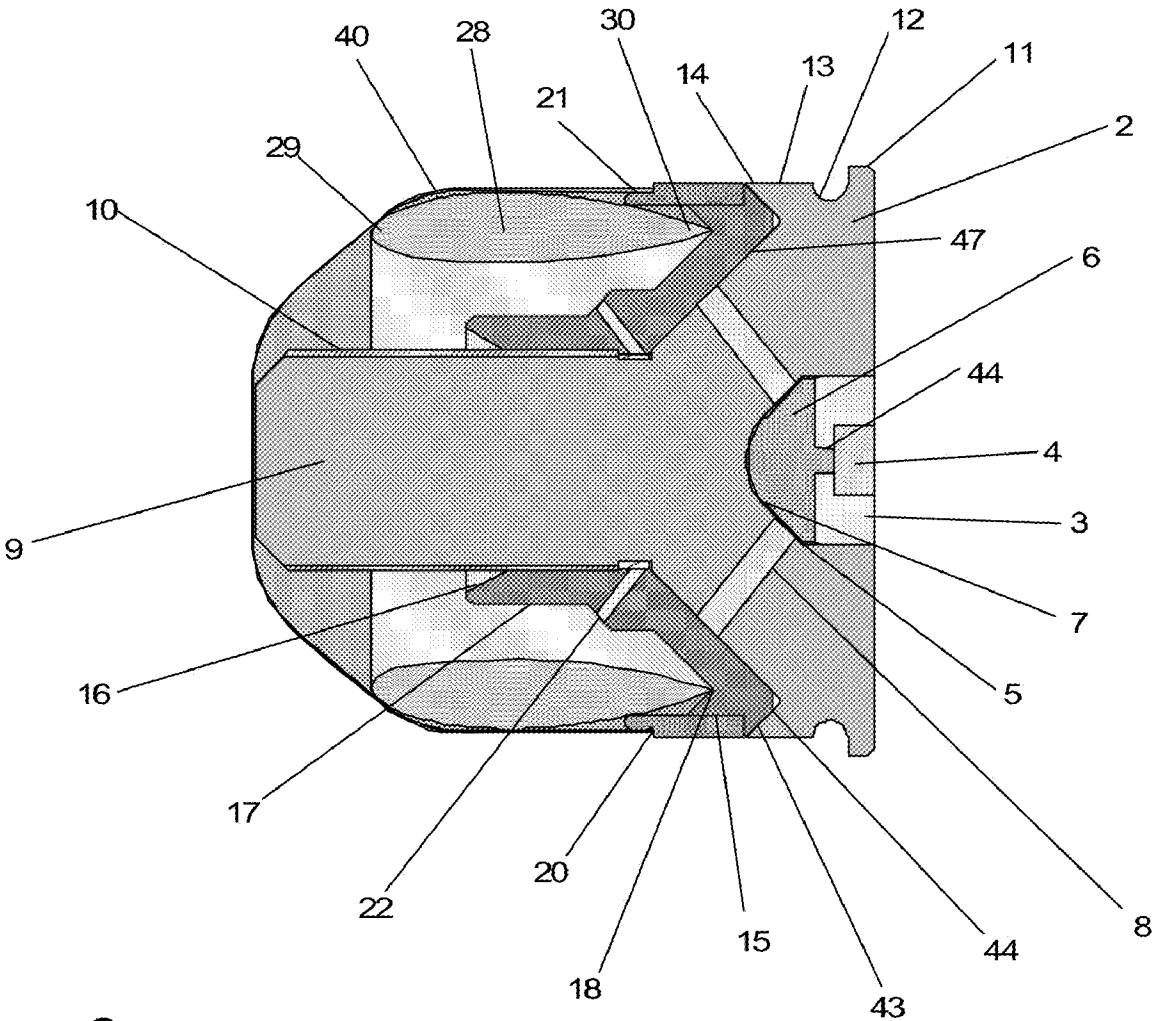
FIG. 3 illustrates a side sectional view of the Ring Airfoil Glider Expendable Cartridge Ammunition.

In the preferred embodiment, generally referring to FIG. 3 in detail, a Ring Airfoil Glider Expendable Cartridge has a cartridge case base 2 with a substantially conical aft section containing a combustion chamber 7 that is substantially conically shaped. The combustion chamber 7 has at least one primary gas vent 8 communicating with the forward outer section of the base's conical section. All the components of the inventive round are preferably made of a moldable plastic and may be either molded, grown as in 'rapid prototyping' manufacture, or machined. Other materials may be accommodated as is customary with ammunition manufacture.

The primary gas vents 8 are typically 2.3 mm in diameter for a 40 mm bore launcher. A powder cup 5 closely fits and seals the combustion chamber's 7 forward end. The powder cup 5 is preferably made of a thin metal sheet such as copper about 0.13 mm thick. A propellant 6 is contained in the cup and preferably consists of fast burning rate smokeless gunpowder. A primer 4 and a primer holder 3 assembly is used to seal the aft terminus of the combustion chamber 7 in the cartridge case base 2.

The base's conical section has at its aft outer diameter a rim 11 and rim groove 12 for interfacing with a conventional grenade launcher or tear gas gun. A cylindrical section 13 located just forward of the rim groove 12 is provided on the cartridge case base 2 and centrally locates the inventive cartridge within a chamber 37 provided at the aft terminus of a barrel 36 of the launcher and provides a lip 14 to help prevent propellant gases from escaping into the launcher's firing mechanism, along with the rim 11 sealing against the launcher barrel's chamber 37, see FIG. 4.

Centrally located at the forward end of the conical section is a cylindrically shaped sabot guide 9. The sabot guide 9 has at least one spiral groove and land to form a rifling 10 to spin a sabot 15. The sabot 15 is mounted on the sabot guide 9 with a central passage 16 through the sabot 15 with at least one spiral land and groove that is closely fitted to the sabot guide 9. The forward end of the sabot 15 has a bearing body 17 section that is substantially tubular to increase the bearing area between the sabot 15 and sabot guide 9 and its rifling 10. Additionally, the sabot guide 9 is thickened in an area at its aft end to reinforce the bearing body 17 against gas pressure and forces from the rifling 10.

Figure 14:
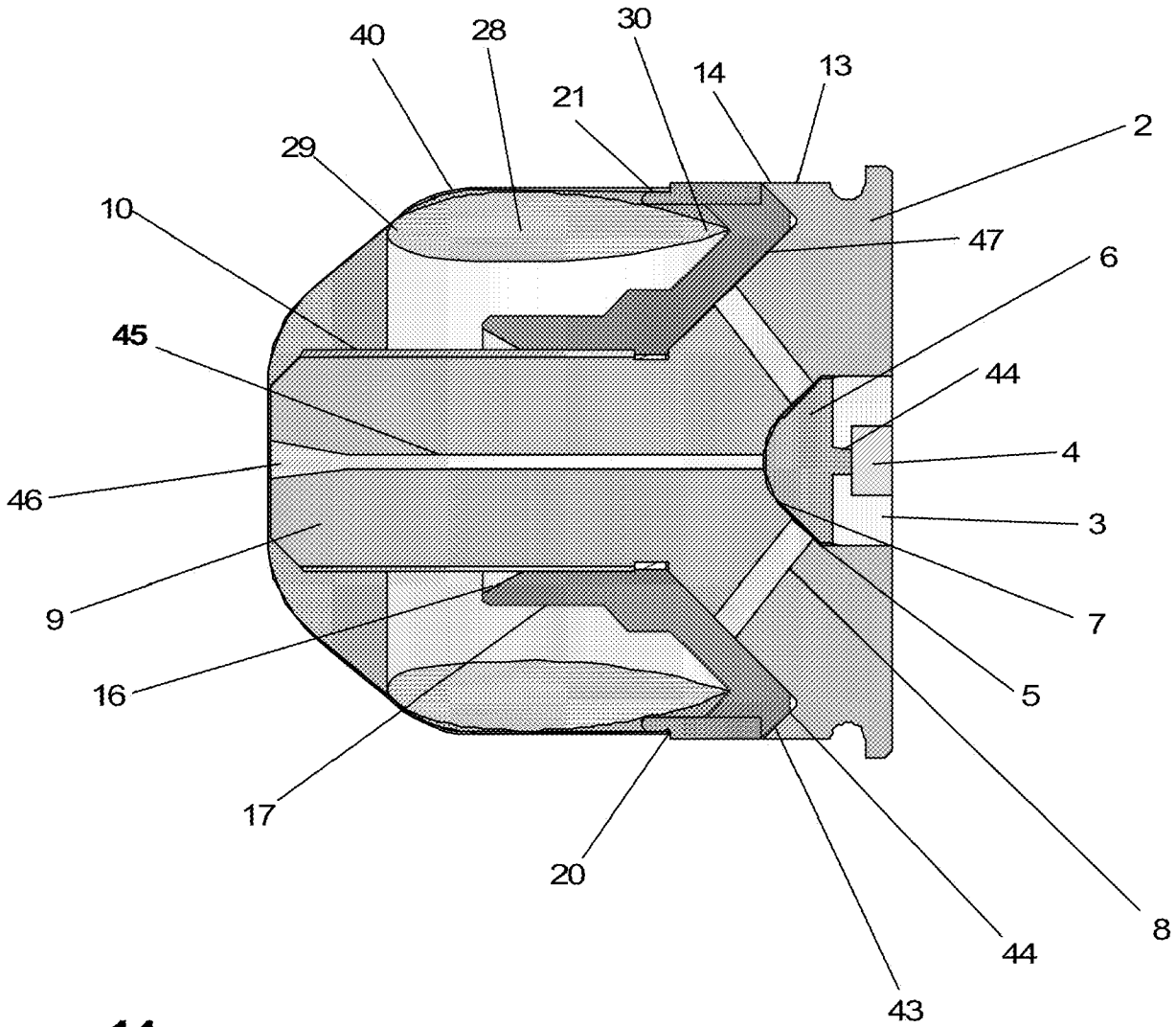
FIG. 14 illustrates a side sectional view of the Ring Airfoil Glider Expendable Cartridge Ammunition with an alternative quaternary gas vent
Figure 15:
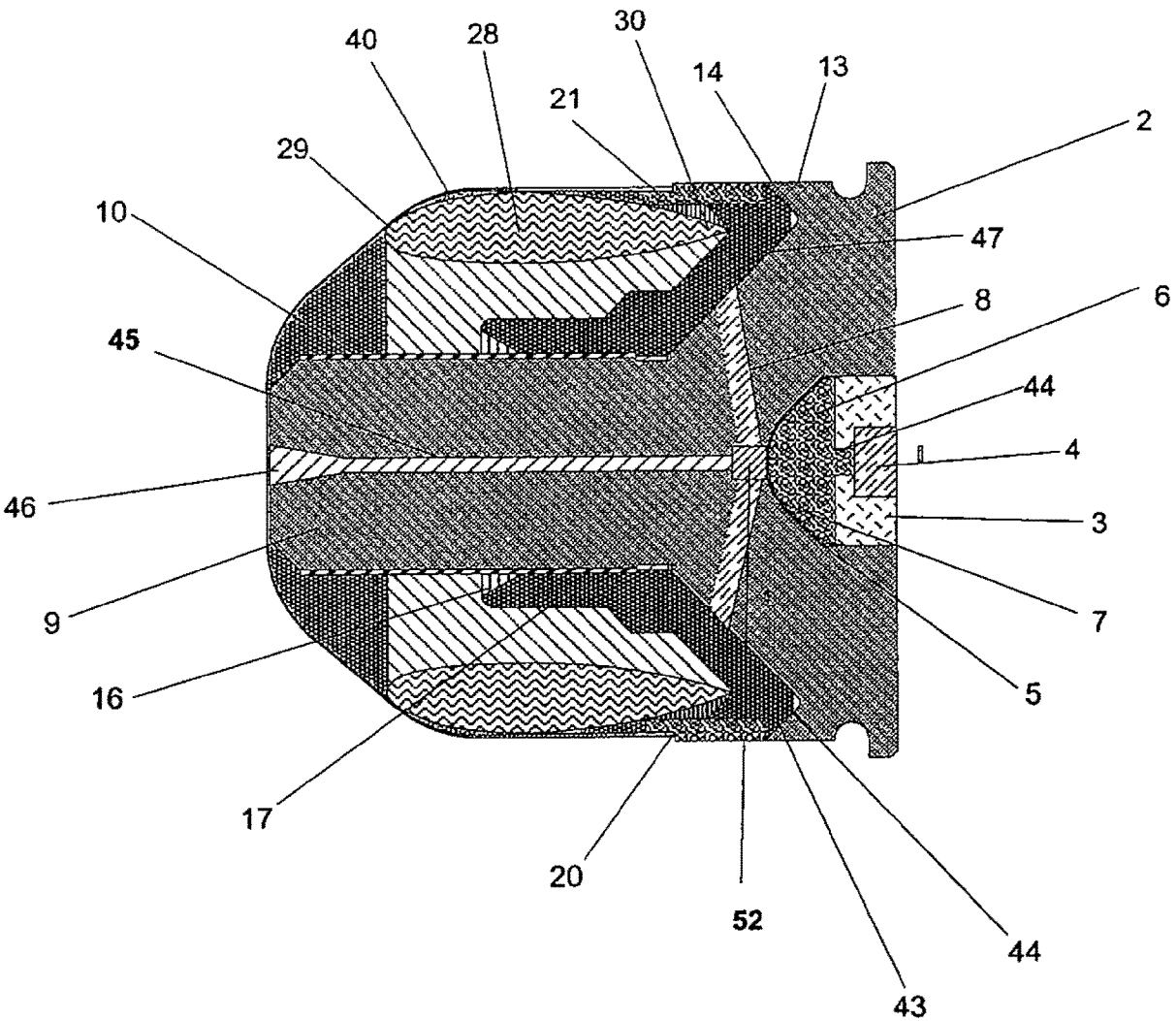
FIG. 15 illustrates a side sectional view of the Ring Airfoil Glider Expendable Cartridge Ammunition with an alternative central gas primary vent and quaternary gas vent.

Preferably, at least one secondary vent 22 is provided in the bearing body 17 at the thickened area to communicate between the aft side of the sabot 15 and its forward side to inflate and fracture the cover 40. Alternatively, referring to FIG. 13, at least one ternary gas vent 45 may be provided in the sabot 15 in the area radially outboard of where the projectile trailing edge 30 contacts the sabot to communicate between the aft side of the sabot and its forward side to inflate and fracture the cover 40. And alternatively, referring to FIG. 14, at least one quaternary gas vent 49 may be provided in the base 9 located axially center to communicate between the combustion chamber 7 and the forward volume of the cover 40 to fracture the cover 40. A typical size of secondary gas vent 22, tertiary gas vent 49 or quaternary gas vent is 1.0 m for a 40 mm launcher bore. An alternative gas handling arrangement is shown in FIGS. 14 and 15 may be used as described later on.

The body of the sabot is a conically shaped thin section 47 attached to the aft end of the bearing body 17. The aft side of the sabot 15 forms a conical recess to nest onto the base's 2 forward conical section. An alignment groove 18 is formed into the front side of the sabot 15 to mate a ring airfoil glider 28. Surrounding the outer periphery of the sabot 15 is a sabot ring 19 that can be either formed as an integral part of the sabot 15 or separately attached at a bond line 21 to become an integral part of the sabot 15. The sabot ring 19 forms a sliding fit with the chamber 37 of the launcher's barrel 36, see FIG. 4, and a slight interference fit with the barrel 36 or the barrel rifling 50. The aft end of the sabot has a chamfer 43 around its periphery that meets the conically shaped aft side to form a circular contact projection 44 on the base of the sabot 15. This shape of the sabot 15 at the circular contact projection simulates the forward contact shape of the glider to provide a safe impact surface in case of hitting a bystander.

Figure 8:
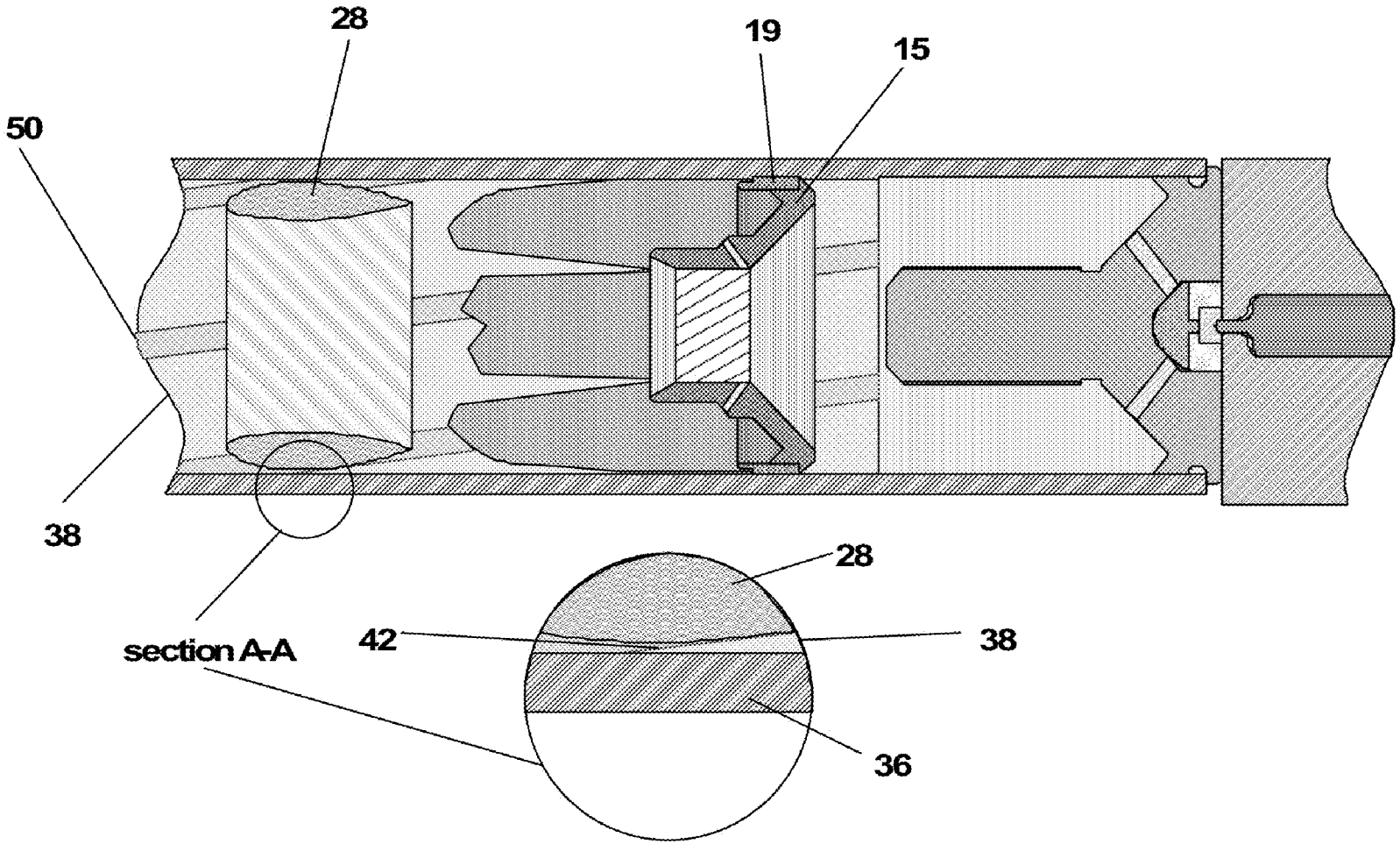
FIG. 8 illustrates a side sectional view of the Ring Airfoil Glider Expendable Cartridge Ammunition, during launch: flight of glider down bore and sabot deceleration in a gun barrel chamber mechanism.

The ring airfoil glider 28 is mounted to the sabot 9 at a conical shaped alignment groove 18 to hold it centrally in place. Referring to FIG. 8, the ring airfoil glider 28 has an outer diameter less than the launcher gun's bore 38 or and barrel rifling 50 so that it can pass down the bore without friction against same. The clearance between the bore and the glider is preferably no less than 0.1 mm to a maximum of 2.0 mm, directly varying and depending on the bore diameter, with the 40 mm size the preferred radial clearance being 0.5 mm but no more than 1.0 mm so as to create a centering aircushion effect upon launch.

Back to FIG. 3, the forward edge of the sabot ring 19 is formed a cover groove 20 for mounting a cover 40. The cover 40 is a thin shell or membrane to both hold the glider 28 in place, until firing the round, and seal out contaminates during storage and transport of the inventive cartridge. The cover 40 is typically about 0.15 mm thick vacuum formed plastic material. It is attached to the sabot ring 19 at a bond line 21 that unites the cover 40 and sabot 15 into one integral piece. The cover 40 holds the ring airfoil glider 28 seated in place in the alignment groove 18 on the sabot 15 until the cartridge is fired.

Figure 11:
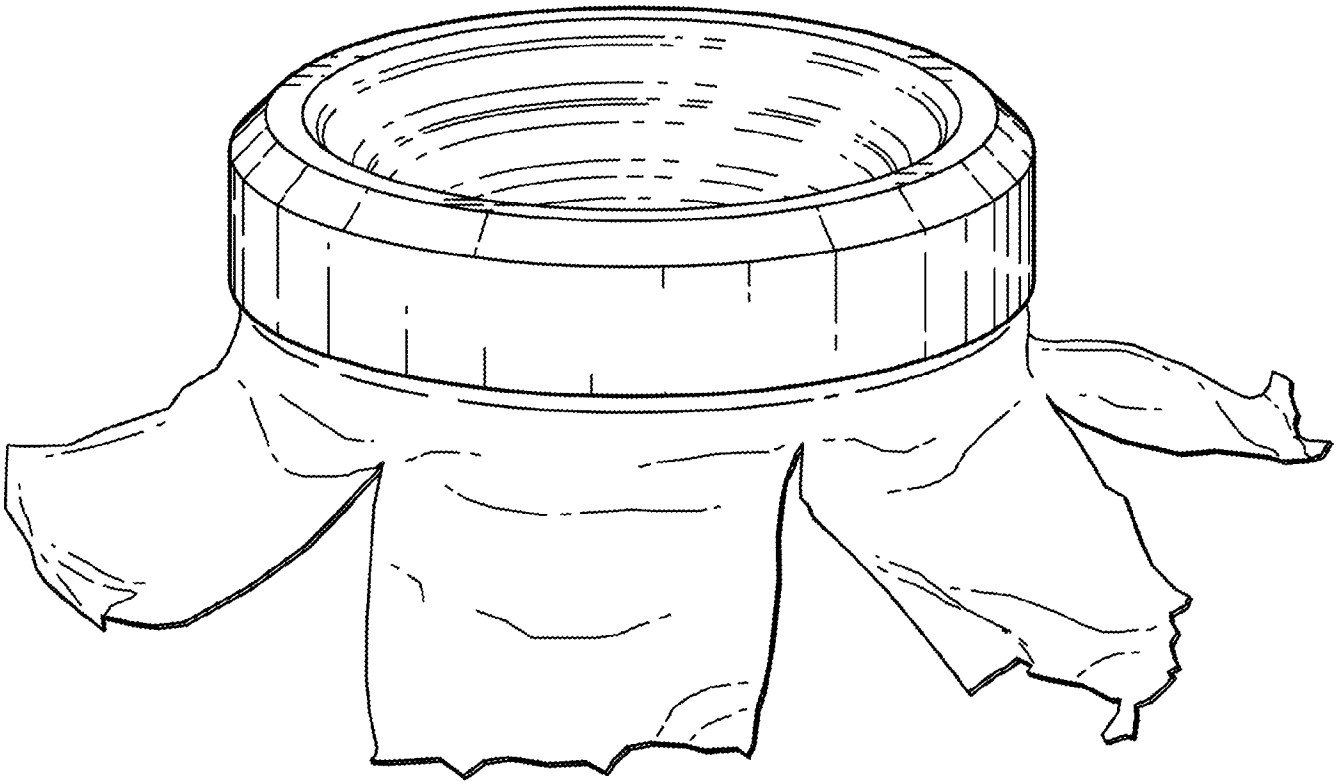
FIG. 11 illustrates an aft side isometric perspective view of the sabot, 40 mm size, after launch showing petals in cover.

The cover 40 has either alone or in combination at least one cover dimple 24 and/or scoring 25 to form a fracture line, as shown in FIG. 2*a*. A series of cover dimples 24 and/or scoring 25 lines are evenly spaced around the outer periphery of the cover 40 to provide one or more fracture points in the cover 40 to release the glider 28 on launch and form a high air drag producing pedaled surface 26 surrounding the sabot 15, as shown in FIG. 11.

Referring to FIG. 2*a*, preferably, the cover 40 is injection molded and has a thickened area, doubling the cover basic thickness, over its forward end to form a cover reinforcement 48 which tapers to a series cover reinforcement projections 51 axially pointed and evenly spaced around the periphery of the cover 40 wherein the projection points coincide with cover dimples 24 and 1 or scoring 25 lines to provide one or more fracture points in the cover 40 to release the glider 28 on launch. The cover reinforcement 48 helps strengthen the cover 40 against handling damage and helps in the reliable splitting of the cover 40 to form a high air drag pedaled surface surrounding the sabot upon launch to decelerate the sabot in its flight path.

Figure 10:
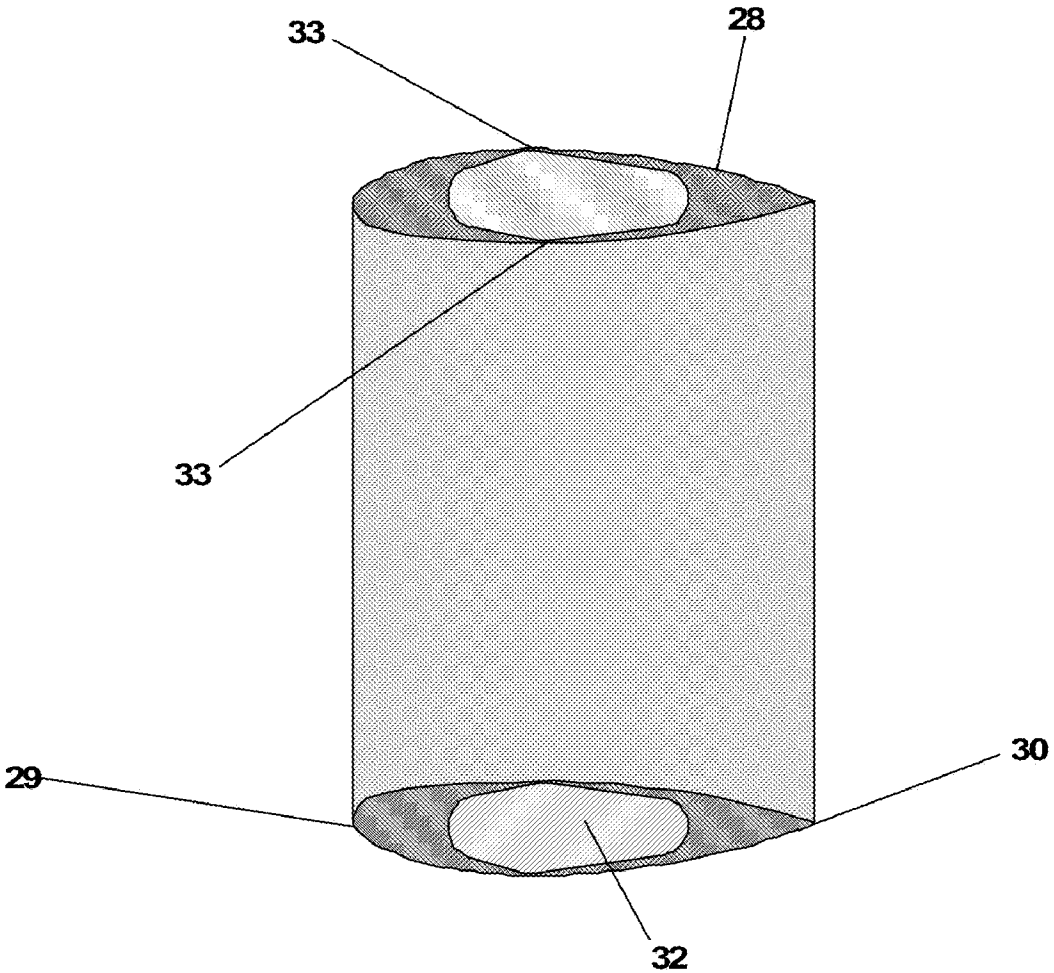
FIG. 10 illustrates a side sectional view of the preferred Ring Airfoil Glider.
Figure 12:
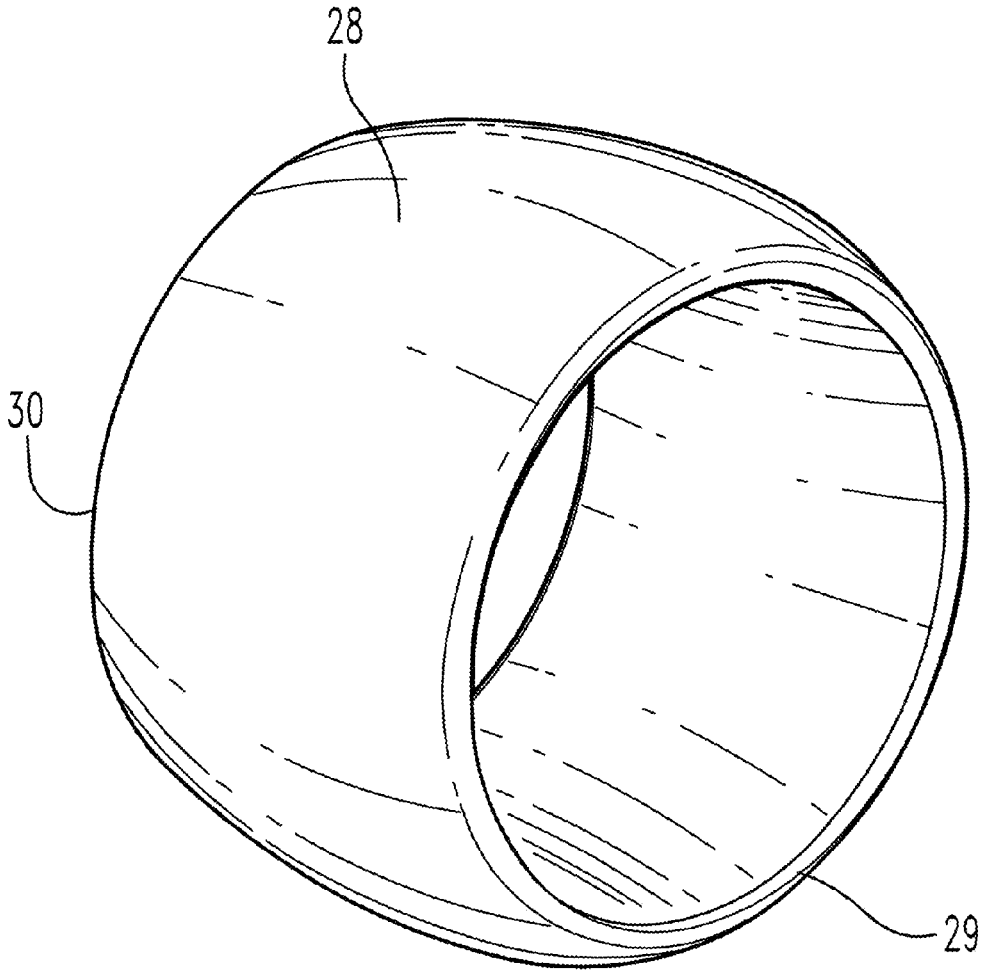
FIG. 12 illustrates a side isometric perspective view of the Ring Airfoil Glider, 40 mm size.

The ring airfoil glider 28 is substantially tubular and has a rounded leading edge 29 and relatively sharp tailing edge 30, referring to FIG. 12 in perspective and FIG. 10 in detail of a preferred embodiment. The ring airfoil glider's 28 outer periphery is preferably the more curved or usual upper portion of an airfoil section. The glider's 28 inner diameter is the flatter section of the airfoil. Any airfoil section is suitable but the most preferred is a section having its center of gravity coincide with its center of pressure during flight. The airfoil section may be turned inside out, with the flatter section outside and more curved section inside. The inside out glider can choke the airflow though the glider's center and increase drag in comparison with the more preferred configuration.

Whichever, the ring airfoil glider 40 is slightly smaller than the launcher's barrel 36 bore 38. The ring airfoil glider 28, referring to FIG. 9 cutaway perspective view, may have at least one siren groove 34 formed as an groove at angle to the centerline of the projectile on its curved airfoil body to create a sound effect to scare the targeted rioters or troublemakers by angularly rotating in the airflow over the airfoils surface to set up a vibration in the air, creating a wailing sound. Preferably, a series of evenly spaced spiral siren grooves 34 is provided on the inner airfoil section of the glider 28 are formed with a spiral equaling the spin rate of the glider 28 to minimize drag forces with dimensions of 0.2 mm wide and deep and a length of at least twice the width.

Figure 9:
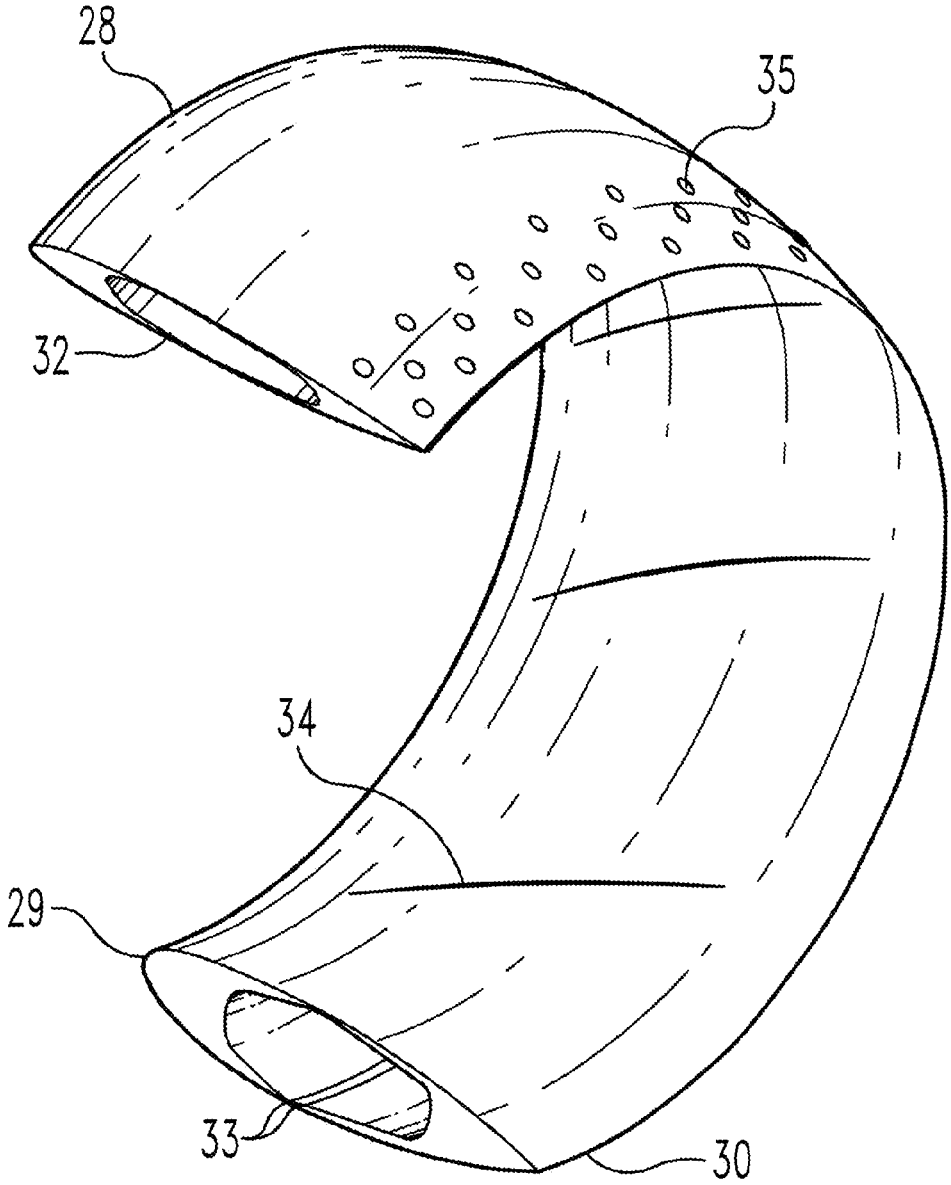
FIG. 9 illustrates a aft left isometric inside partial sectional view of the preferred Ring Airfoil Glider.

An evenly spaced series of glider dimples 23, referring to FIG. 9, may be provided on the airfoil surfaces of the glider 28 to minimize drag on the glider 28 by causing a thin layer of turbulence next to the airfoil's surface as the angle of attack increases with the airflow. The glider dimples 23 are more effective on the more curved section of the airfoil surfaces on the glider 28. The glider dimples 23 are most effective towards the outer trailing edge 30 of the airfoil surface with a conventionally configured glider 28. However, with an inside out configured airfoil the glider dimples 23 are effective on the inner airfoil surface section starting from just aft of the leading edge 29 through the trailing edge 30. The dimples are preferably a segment of a sphere about one-third as deep as they are in diameter where that diameter typically is around 2.0 mm. Additionally, the ring airfoil glider 28, referring to FIGS. 9 and 10, may have a payload cavity 32 formed internally to provide a means of delivering a payload such as an irritant pepper, tear gas, olfactory agent, and I or marker dye material. The cavity 32 has a cavity hinge 33 at its inner and outer inside periphery that is formed by tapering the wall thickness of the ring airfoil glider 28 to a thin slightly axially elongated section at the airfoil section thickest part of the glider 28 around its circumference. The hinge 33 provides a means to deform and break the ring airfoil glider 28 upon impact to release the payload. The hinge 33 is best as thin as possible to withstand the launching and handling stress encountered by the round, hinges as thin as approximately 025 mm have worked with 40 mm gliders.

Figure 13:
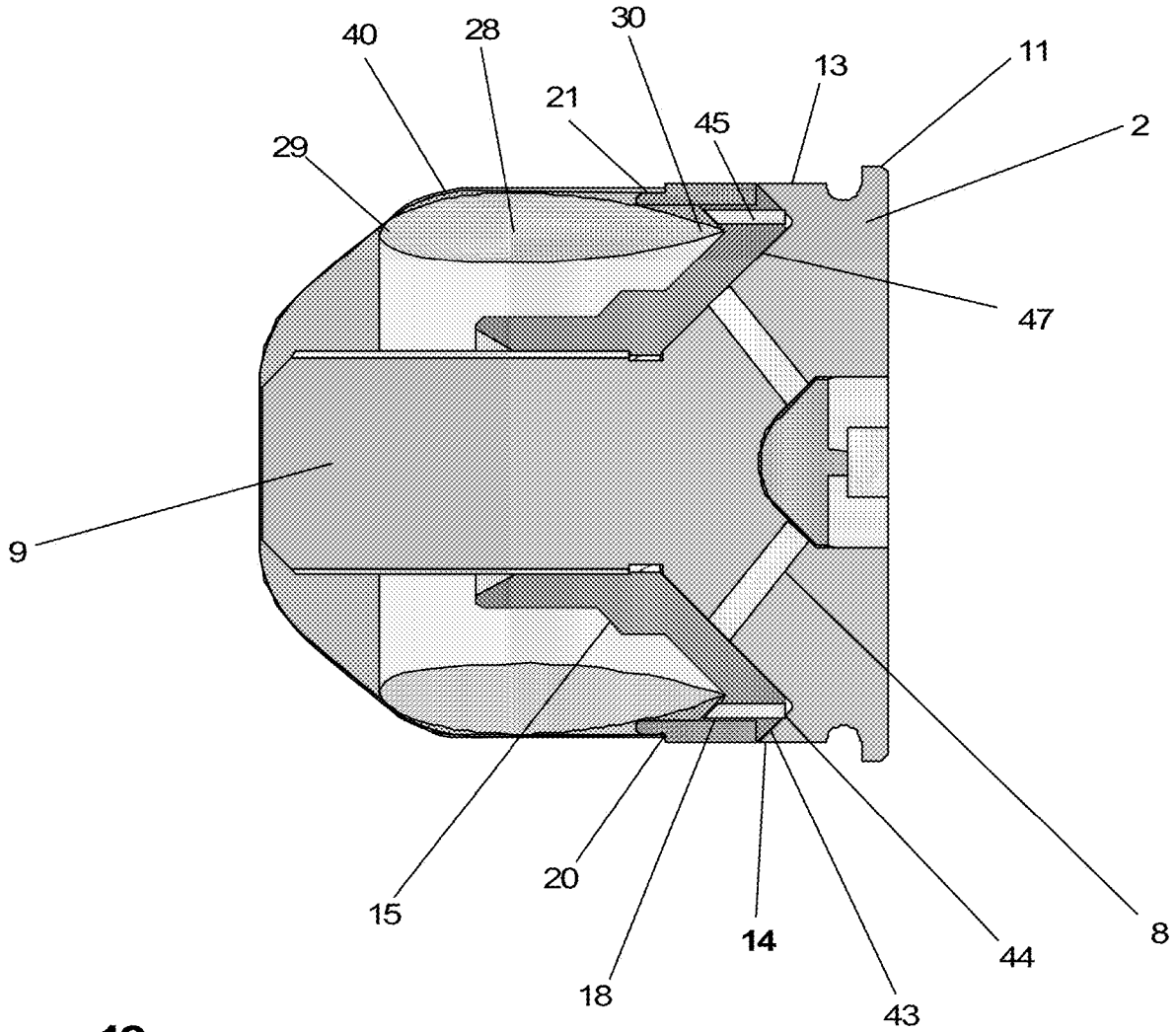
FIG. 13 illustrates a side sectional view of the Ring Airfoil Glider Expendable Cartridge Ammunition with an alternative ternary gas vent

In reference to FIG. 13, one or more ternary gas vent 45 may be used either in place of the secondary gas vent to inflate and fracture the cover 40 upon launch of the ring airfoil glider 28. The gas passes over the glider to inflate the cover. Alternatively, in reference to FIG. 14, one or more quaternary gas vent 49 may be used either in place of the secondary gas vent or ternary vents to inflate and fracture the cover 40 upon launch of the ring airfoil glider 28.

Upon launch the gas ruptures the propellant cup 5 at the vent hole passing down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch.

Upon launch the gas ruptures the propellant cup 5 at the vent hole passing down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch. Alternatively, in reference to FIG. 15, one or more quaternary gas vent 49 may be used either in place of the secondary gas vent or ternary vents to inflate and fracture the cover 40 upon launch of the ring airfoil glider 28.

Upon launch the gas ruptures the propellant cup 5 at the vent hole forming the central gas primary vent 52 whereupon it both passes down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch. During launch the gas ruptures the propellant cup 5 at the vent hole passing down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch. And, most of the gas escapes simultaneously through the primary gas vent 8 or vents the communicate as branches off the central gas primary vent 52 and is used to propel the sabot 8 and ring airfoil glider 28 to launch the same.

Figure 4:
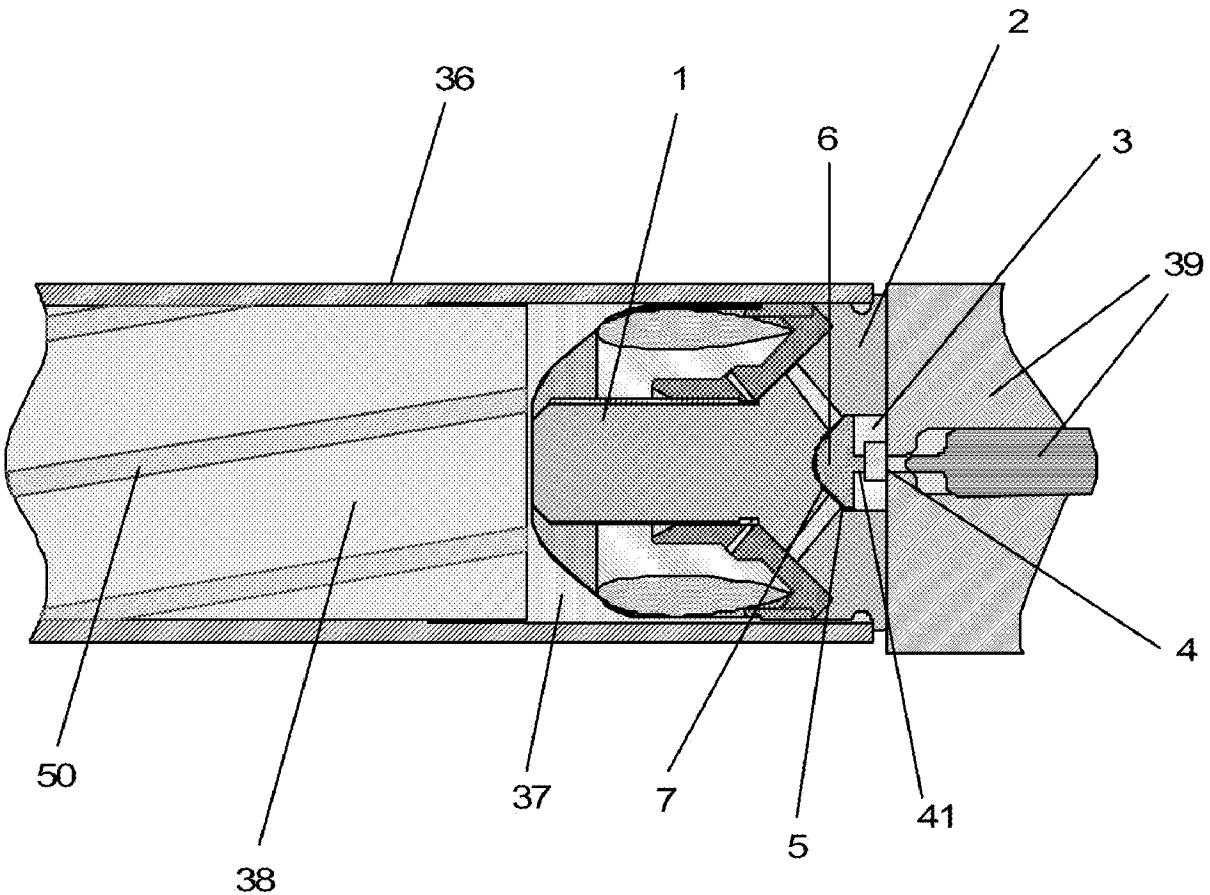
FIG. 4 illustrates a side sectional view of the Ring Airfoil Glider Expendable Cartridge Ammunition loaded in a gun barrel chamber mechanism.

Operating Description:

In use, as with most cartridge ammunition, the inventive cartridge 1 is loaded into a gun to fire it, referring to FIG. 4: illustrates a side sectional view of the Ring airfoil glider expendable cartridge 1 ammunition loaded in a gun barrel chamber mechanism. The barrel 36 of the launcher typically has a chamber 37 that terminates in a bore 38. The launcher typically has a firing and breech mechanism 39. The aft end of the combustion chamber 7 is sealed by a primer holder 3. The primer holder 3 holds the primer 4 in place and has a priming passage 41 from the primer 4 to the combustion chamber 7 to allow passage of the flame produced by the primer 4 to reach the propellant 6 contained by the propellant cup 5 in the combustion chamber 7.

Figure 5:
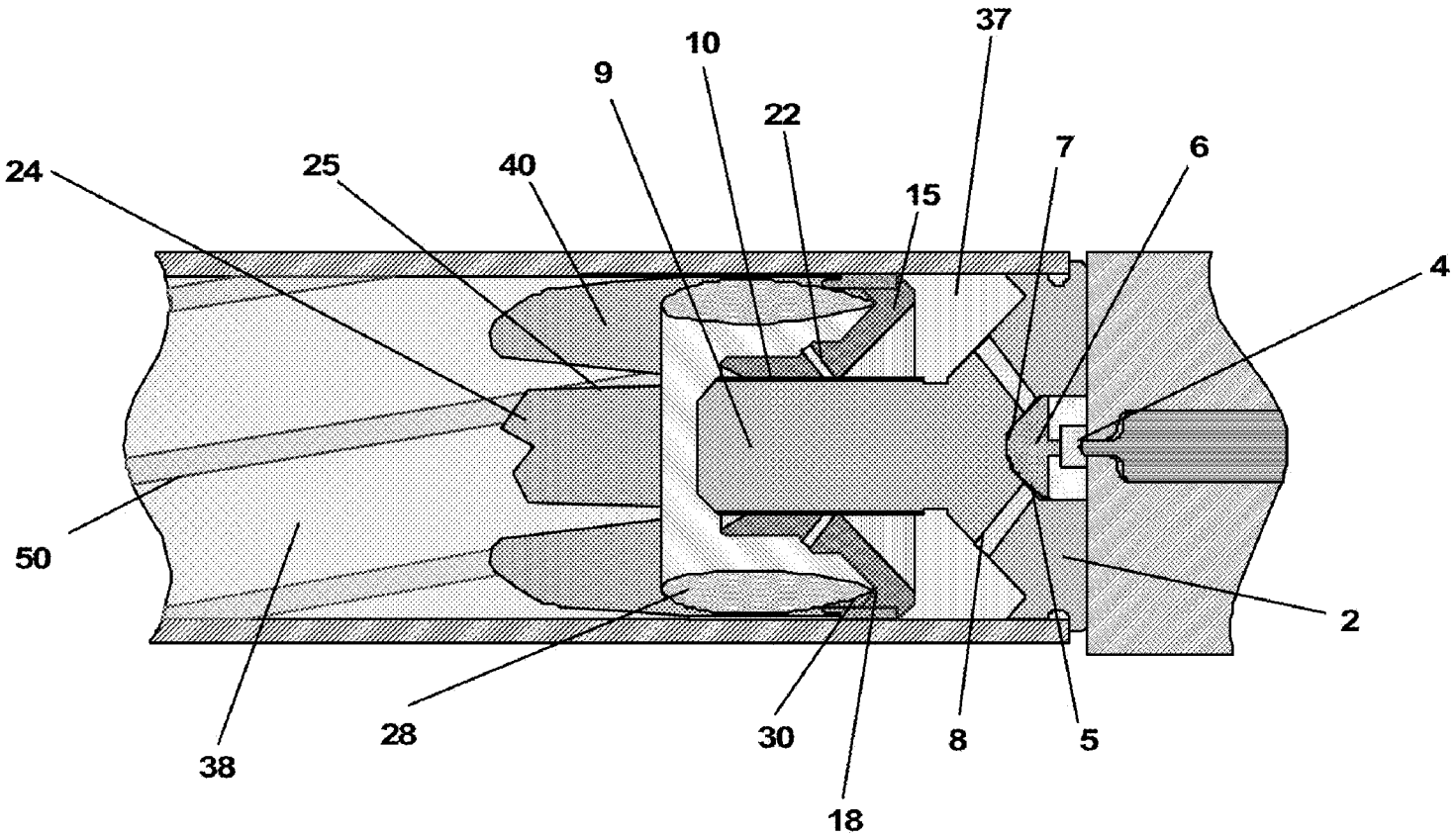
FIG. 5 illustrates a side sectional view of the Ring Airfoil Glider Expendable Cartridge Utility Patent Application Ammunition: during launch acceleration in a gun barrel chamber mechanism.

Upon firing, referring to FIG. 5, the primer 4 is struck by firing mechanism and initiates the burning of the propellant 6 in the combustion chamber 7. The propellant generates a pressurized gas that builds up pressure in the propellant cup 5 that is closely fitted in the combustion chamber 7 in the cartridge case base 2. The propellant cup 5 is supported by the combustion chamber 7 except at the primary vents 8 that allow the propellant gases pressure to build up sufficient pressure to substantially burn the propellant to perforate the propellant cup 5 and escape to expand and push the sabot 15 forward in the chamber 37. Some of the propellant gas escapes from behind the sabot through the secondary vents 22 pressurizing the cover 40 until it ruptures along the fracture lines provided by the cover dimples 24 or scoring 25 acting alone or in combination, refer to FIG. 2*a*.

Figure 6:
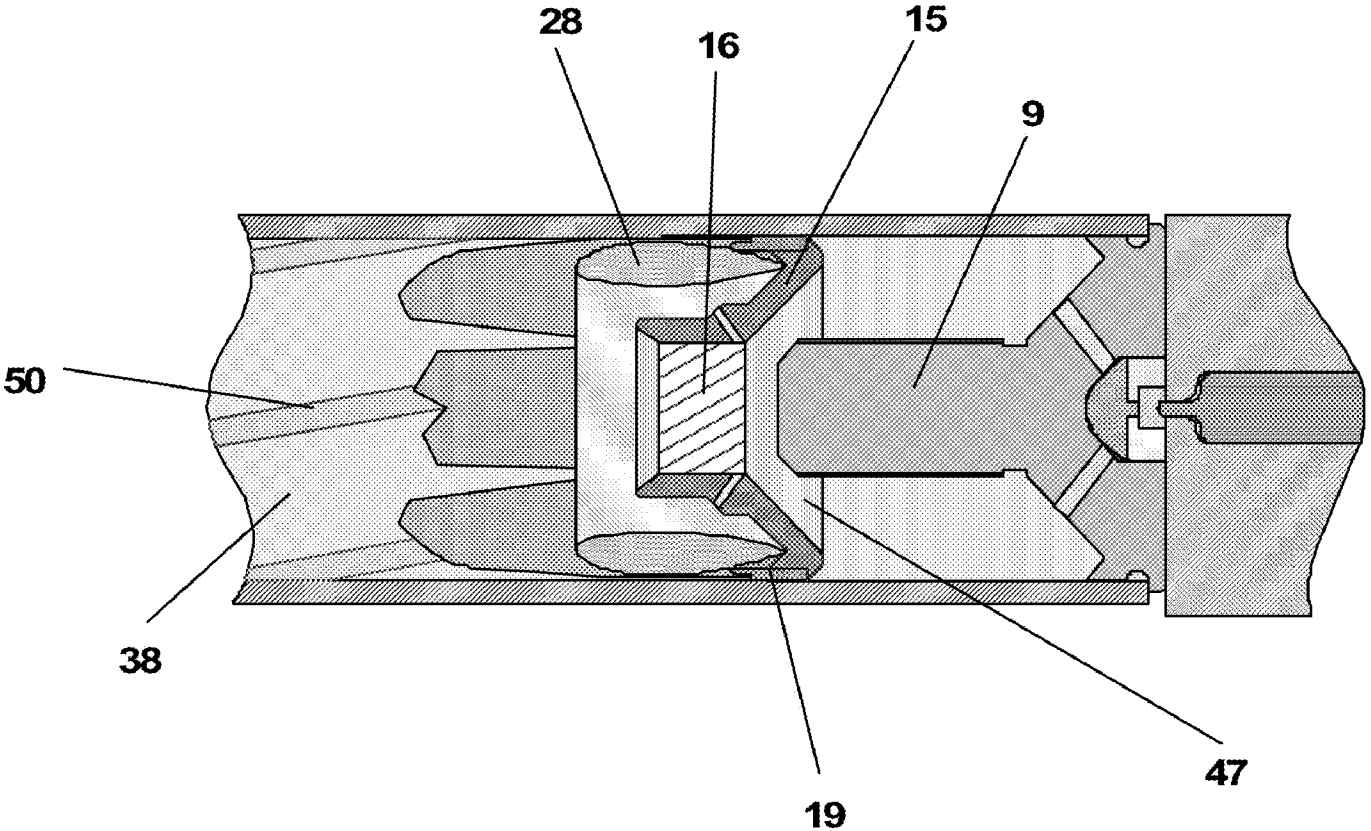
FIG. 6 illustrates a side sectional view of the Ring Airfoil Glider Expendable Cartridge Ammunition, during gas blow down phase in a gun barrel chamber mechanism.

The glider 28 is firmly held and aligned in place in the sabot 15 at the alignment groove 18 by the inertial acceleration force generated by the expansion of the propellant gas, see FIG. 5. As the sabot 15 travels forward in the combustion chamber 7 the rifling 10 on the sabot guide 9 rod rotates it, preferably, at a rate of 10,000 rpm or more which spins the glider 28 by friction between the alignment groove 18 and trailing edge 30 of the glider 28. Referring to FIG. 6, just before the sabot 15 enters the bore 38 it slides off the end of the sabot guide 9 rod and releases the pressurized propellant gas. The conical shaped thin section 47 at the back of the sabot 15 helps funnel the gas though the center passage 16 of the sabot 15. The gas is directed in front of the glider 28 and down the bore 38 by the center passage 16 to prevent it from upsetting the glider 28 and causing it to wobble.

Figure 7:
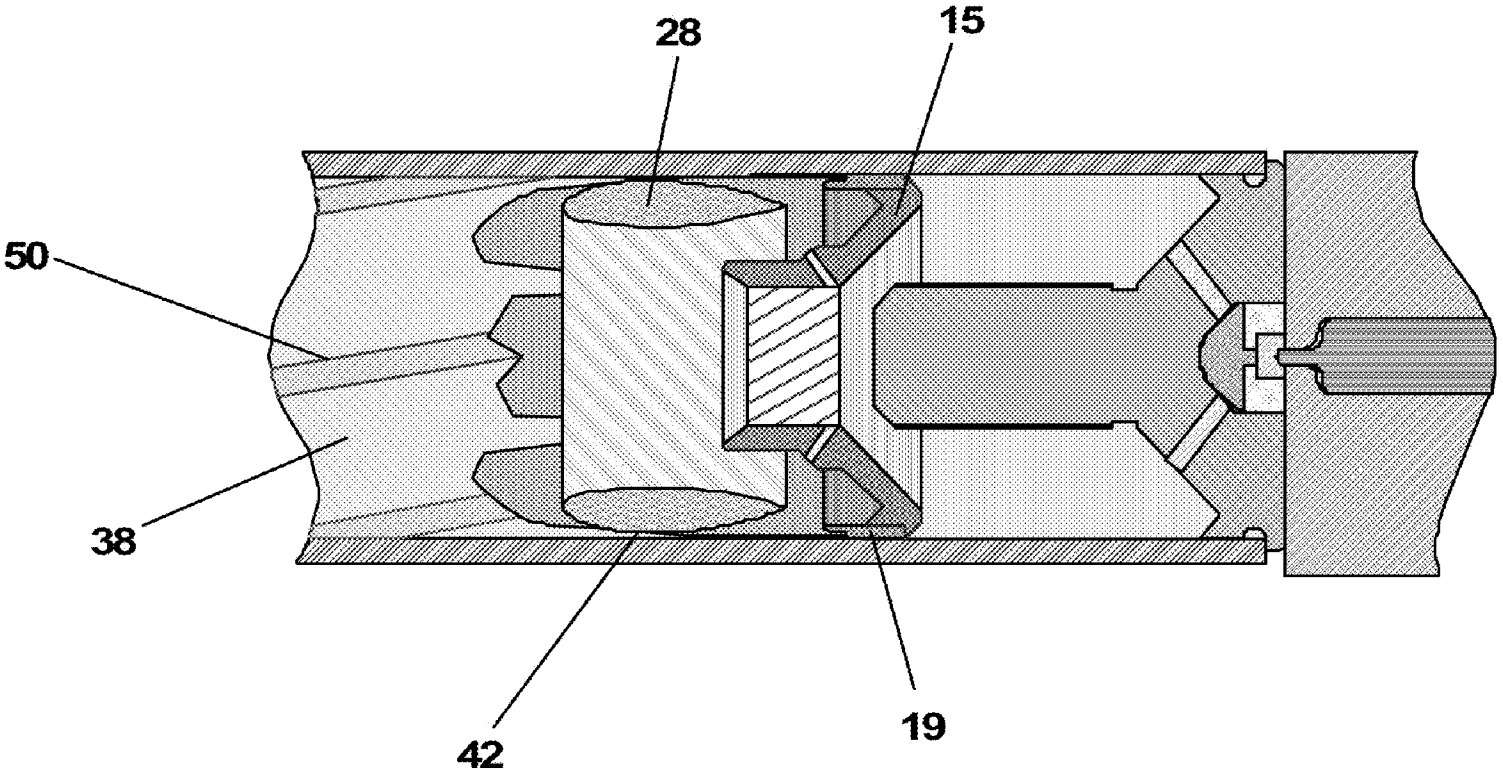
FIG. 7 illustrates a side sectional view of the Ring Airfoil Glider Expendable Cartridge Ammunition: at point of glider/sabot separation in a gun barrel chamber.

Preferably, at the point of encountering the edge of the bore 38 and any associated rifling, the sabot ring 19 forms a tight fit in the bore 38. Referring to FIG. 7, the sabot 15 is decelerated by the friction produced between the ring 19 and the bore 38 and or barrel rifling 50 by the movement of the sabot 15 because the propellant gases have escaped down the bore 38 ahead of the glider 28 and no longer push forward on the sabot. At this point, the glider 28 separates from the sabot 15, by its inertia and due to the difference in friction situations experienced by the sabot 15 and ring airfoil glider 28, The cover 40 is fractured and no longer retains it, and it does not touch the bore 38. The combination of clearance between the glider 28 and the bore 38 and the glider's forward movement and associated airflow around its periphery produces a cushioning turbulent boundary layer 42 of air in the gap between the bore 38 and glider 28.

Referring to FIG. 8, the sabot 15 is gradually decelerated by the friction between the bore 38 and the sabot ring 19. The glider 28 is centered and stabilized by the turbulent boundary layer 42 of air between the bore and periphery of the glider 15 due to the movement of the glider 15 and clearance between the bore 38 and glider 15 (preferably, a clearance of approximately 0.5 mm radially on a 40 mm glider). The glider 15 exits the bore 38 and travels down range. The sabot 15 exits the muzzle behind the glider 28, delayed by the bore friction resulting in the loss much of its original velocity reducing its kinetic energy rendering it safer to friendly personnel nearby.

Upon exiting the bore 38 and encountering drag of the air flowing over and through it, the sabot 15, in its preferred embodiment shown in FIG. 11, turns around like a badminton bird. The petals 26 formed in the cover 40 along the scoring 25 attached to the forward end of the sabot 15 increase air drag on it while the aft end of the sabot 15 has most of its mass causing it to turn around in flight. The inventive sabot's 15 drag features both inside the gun bore and in flight down range cause it to fall to the ground about 20 meters down range. This allows it to be safely fired over friendly troops. The sabot's limited kinetic energy and mass make it safe in cases of accidentally striking someone nearby the gun muzzle.

To further limit the damage from an accidental impact with the sabot 15 the aft end of the sabot, shown in FIG. 11, has the chamfer 43 around its periphery that meets the conically shaped thin section 47 to form the circular contact projection 44 on the base of the sabot 15. This shape of the sabot 15 simulates the shape of the glider upon impact with flesh so as to produce a 'w' shaped cross sectional deformation in the flesh to better dissipate the sabot's energy in the surface tissues to limit injury. The glider 15 has very greatly improved flight characteristics due to its streamlined shape, hollow center, and lift generated by its airfoil shape. One preferred embodiment of glider 15 is show in FIG. 10 has a payload cavity 32 formed internally to provide a means of delivering a payload such as an irritant pepper, tear gas, olfactory agent, and/or marker dye material. The payload cavity 32 can be used to simply reduce the weight of the sabot 15 or provide a collapsible section to limit injury.

The impact of the payload delivery glider with a target causes the glider to deform alone the hinges about midpoint along the length of the cavity 32. The hinges 33 are formed as significantly reduced cross sections of the glider body to weaken it. As the glider 28 deforms the payload material, preferably a powder but may be in liquid form, a radial acting pressure is produced to further stress the material of the hinges 33 until one or both hinges break to allow the escape of the payload to deliver an effect on the target as is specific to the payload chosen. Depending on the desired effect the hinges 33 may have their thickness and length of the reduced section varied to break simultaneously, where both hinges have equal bending resistance and strength; the outer hinge is less stiff and strong than the inner hinge to deliver the payload in an outward direction to cover the target, or; the inner hinge is less stiff and strong than the outer to deliver the payload in a concentrated area on the target. The spinning of the glider 28 helps to distribute the payload in the former two cases.

In reference to FIG. 13, one or more ternary gas vent 45 may be used either in place of the secondary gas vent to inflate and fracture the cover 40 upon launch of the ring airfoil glider 28. The gas passes over the glider to inflate the cover. Alternatively, in reference to FIG. 14, one or more quaternary gas vent 49 may be used either in place of the secondary gas vent or ternary vents to inflate and fracture the cover 40 upon launch of the ring airfoil glider 28. Upon launch the gas ruptures the propellant cup 5 at the vent hole passing down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch. Upon launch the gas ruptures the propellant cup 5 at the vent hole passing down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch.

Alternatively, in reference to FIG. 15, one or more quaternary gas vent 49 may be used either in place of the secondary gas vent or ternary vents to inflate and fracture the cover 40 upon launch of the ring airfoil glider 28. Upon launch the gas ruptures the propellant cup 5 at the vent hole forming the central gas primary vent 52 whereupon it both passes down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch, whereupon during launch the gas ruptures the propellant cup 5 at the vent hole passing down the length of the sabot guide 9 to a expansion cone 46 which spreads the force of the gas out over the inside of the cover 40 forward nose inflating it and causing it to rupture to allow passage of the ring airfoil glider 28 and its separation from the sabot 15 during launch. And, most of the gas escapes simultaneously through the primary gas vent 8 or vents the communicate as branches off the central gas primary vent 52 and is used to propel the sabot 8 and ring airfoil glider 28 to launch the same.

What is claimed is:

1. A munition for launching in a barrel of a breech loading gun, comprising:

a circular base supported within the breech, said base including a vent for directing compressed gas toward a sabot;

a generally cylindrical rod extending toward a muzzle of the barrel from the center of said base;

a ring airfoil projectile adapted and configured to be launched from within the barrel;

a sabot having a central passage that accepts therein said rod, the central passage and said rod being in sliding contact, said sabot having two opposite surfaces with one surface facing said base and being in fluid communication with the vent and the opposing surface being adapted and configured to push said projectile;

wherein compressed gas flowing through the vent acts on the one surface of said sabot to push said projectile through the barrel;

said projectile separates from the sabot prior to reaching the muzzle of the barrel.

2. The munition of claim 1 wherein said rod has a rifled outer surface, said sabot being guided by the rifling of said rod, and movement of said sabot along said rod spins said sabot.

3. The munition of claim 1 wherein said projectile has a maximum outer diameter that is smaller than the inner diameter of the barrel.

4. The munition of claim 1 wherein said projectile is adapted and configured for reduced lethality, and said projectile exits the muzzle with a velocity greater than ninety six meters per second.

5. The munition of claim 1 wherein projectile separate from each other and said projectile flies within at least a portion of the length of the barrel.

6. The munition of claim 1 wherein said projectile has a substantially open central passage.

7. The munition of claim 1 wherein said projectile has a trailing edge and said sabot is adapted and configured such that said sabot pushes said projectile substantially with line contact at the trailing edge.

8. A munition for launching in a barrel of a breech loading gun, comprising:

a circular base supported within the breech;

a rod protruding from the center of said base and extending toward a muzzle of the barrel, said rod having a rifled outer surface;

a ring airfoil projectile adapted and configured to be launched from within the barrel, said projectile having a maximum outer diameter that is smaller than the inner diameter of the barrel;

a sabot having a central passage that accepts therein said rod, said sabot being guided by the rifling of said rod, said sabot being adapted and configured to push said projectile; and a source of compressed gas;

wherein compressed gas provides a pressure force to push said sabot along said rod, the rifling of said rod interacting with the central passage to spin said sabot, said sabot spinning said projectile and pushing said projectile through the barrel, said sabot and said projectile separating from each other within the barrel.

9. The munition of claim 8 wherein said projectile has a leading edge and a trailing edge and a curved outer surface in between, the maximum outer diameter being intermediate of the leading edge and the trailing edge.

10. The munition of claim 8 wherein the clearance between the barrel inner diameter and the ring airfoil maximum outer diameter is greater than about one tenth of a millimeter and less than about two millimeters.

11. The munition of claim 8 wherein said projectile has a trailing edge and said sabot is adapted and configured such that said sabot pushes said projectile substantially with line contact at the trailing edge.

12. The munition of claim 8 wherein said projectile and said sabot are adapted and configured such that said sabot pushes said projectile toward the muzzle and said sabot does not restrain said projectile after separating from said projectile within the barrel.

13. The munition of claim 8 wherein said projectile is adapted and configured for reduced lethality, and said projectile exits the muzzle with a velocity greater than ninety six meters per second.

14. The munition of claim 8 wherein said projectile has a substantially open central passage.

15. The munition of claim 8 wherein the projectile has a leading end and which further comprises a cover in front of the leading end of the projectile, wherein said cover ruptures in the barrel to release said projectile.

16. A reduced lethality munition for launching in a barrel of a breech loading gun, comprising:

a circular base supported within the breech, said base having a periphery in contact with the barrel;

a generally cylindrical rod extending toward the muzzle of the barrel from the center of said base;

a ring airfoil projectile adapted and configured to be launched from within the barrel, said projectile having a maximum outer diameter that is smaller than the inner diameter of the barrel, the maximum diameter being more than about 35 millimeters and less than about 40 millimeters, the projectile having a weight that is less than about fifteen grams;

a sabot having a central passage that is in sliding contact with said rod, said sabot being adapted and configured to push said projectile; and a source of compressed gas;

wherein the compressed gas provides a pressure force to push said sabot along said rod such that said projectile exits the muzzle with a velocity of more than about ninety meters per second;

wherein said projectile separates from said sabot prior to reaching the muzzle end of the barrel.

17. The munition of claim 16 wherein said projectile has a trailing edge and said sabot is adapted and configured such that said sabot pushes said projectile substantially with line contact at the trailing edge.

18. The munition of claim 16 wherein said projectile and said sabot are adapted and configured such that said sabot pushes said projectile toward the muzzle and said sabot does not restrain said projectile after separating from said projectile within the barrel.

* * * * *